US006516536B2

(12) United States Patent
Ryden

(10) Patent No.: US 6,516,536 B2
(45) Date of Patent: Feb. 11, 2003

(54) DRY SUIT DRYER

(76) Inventor: Michael V. Ryden, 62290 JayJay Rd., Montrose, CO (US) 81401

( * ) Notice: Subject to any disclaimer, the term of this patent is extended or adjusted under 35 U.S.C. 154(b) by 15 days.

(21) Appl. No.: 09/879,766

(22) Filed: Jun. 12, 2001

(65) Prior Publication Data

US 2001/0049883 A1 Dec. 13, 2001

Related U.S. Application Data

(60) Provisional application No. 60/210,915, filed on Jun. 12, 2000.

(51) Int. Cl.[7] ..... F26B 25/00

(52) U.S. Cl. ..... 34/106; 34/103; 34/104; 34/202; 34/218; 134/22.1; 134/166

(58) Field of Search ..... 34/103, 104, 106, 34/202, 218; 134/22.1, 100, 166

(56) References Cited

U.S. PATENT DOCUMENTS 4,997,000 A * 3/1991 Feast ..... 134/170
5,379,525 A * 1/1995 Raynor ..... 34/104
5,713,137 A * 2/1998 Fujita ..... 34/106
5,862,606 A * 1/1999 Jannach ..... 34/106

FOREIGN PATENT DOCUMENTS

DE 3912835 A1 * 12/1989 ..... D06F/59/02
EP 468212 A1 * 1/1992 ..... F26B/21/00

* cited by examiner

*Primary Examiner*—Ira S. Lazarus
*Assistant Examiner*—Kathryn S. O'Malley

(57) ABSTRACT

An apparatus for drying "dry suits", HAZ MAT suits, cleanroom suits and the like utilizes a blower and heating elements mounted through a neck, wrist or ankle seal of the suit. The heated and compressed air is discharged into the suit to absorb moisture from the internal suit surfaces, then is discharged through the suit seals, rapidly drying the suit. Inserts for establishing a desired discharge rate from the suit seals are described. The inserts also serve to stretch the neck and arm seals to the proper diameter for maintaining comfortable wear.

44 Claims, 25 Drawing Sheets

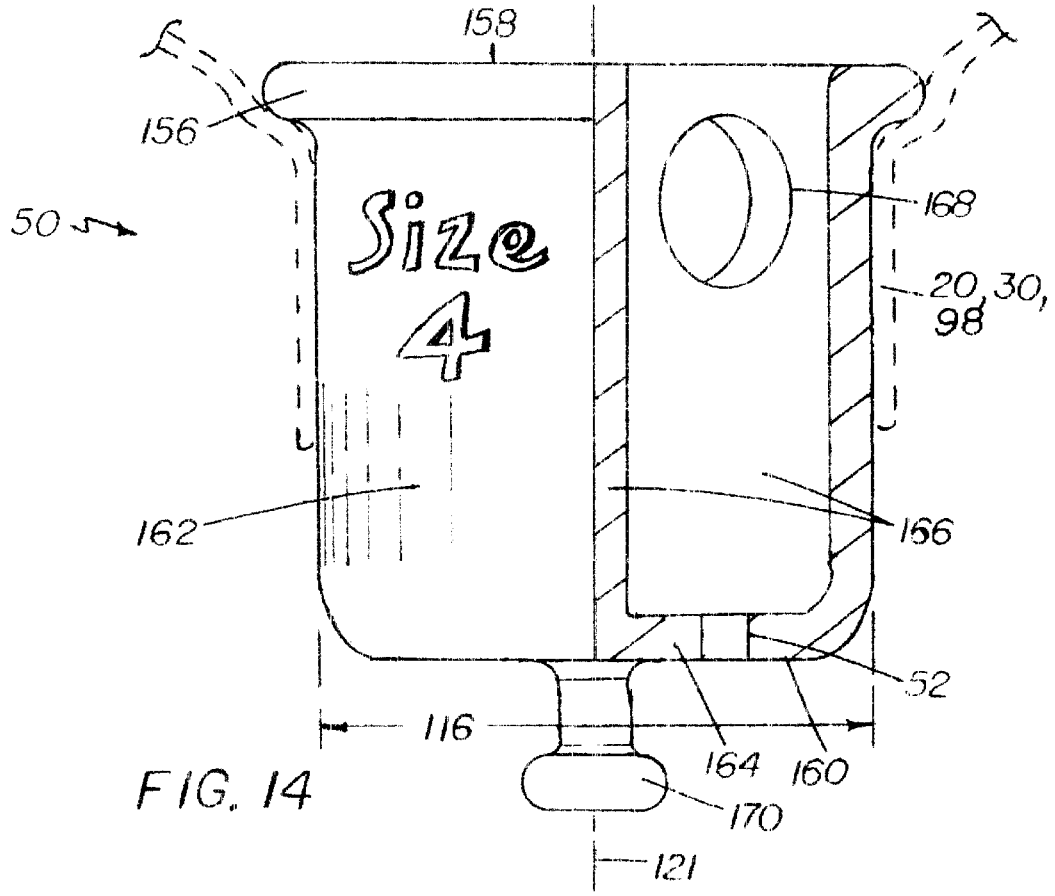
FIG. 14
FIG. 13
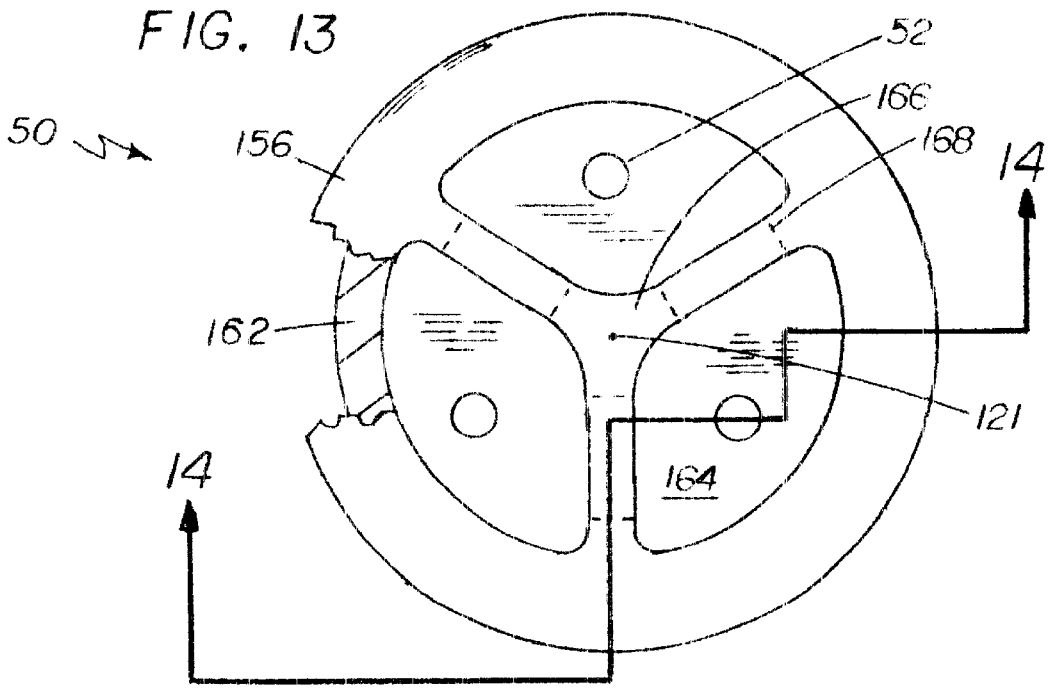

DRY SUIT DRYER

This application claims the benefit of Provisional application Ser. No. 60/210,915, filed Jun. 12, 2000.

BACKGROUND OF THE INVENTION

1. Field of the Invention

This invention relates generally to apparel resistant to particular materials or environmental conditions, including so-called "dry suits" and wet suits for diving, full-body sealed suits and the like used for protection from hazardous materials, fire-fighting apparel, and "cleanroom" clothing. More particularly, the invention pertains to methods and means for cleaning, drying and maintaining the inside of such exposure suits following use.

2. State of the Art

Free underwater diving and swimming using Self-Contained Underwater Breathing Apparatus (SCUBA devices) have become very popular receational pursuits, and have been used for many years in commercial and military applications. Diving without protective wear can be very hazardous, because of cold water, razor-sharp coral formations, contaminated environments, sunken debris, poisonous life forms and the like. Thus, so-called "wet suits" have been in wide use for many years. A wet suit covers a substantial portion of a diver's body, but permits entry of water to contact the diver's skin. The insulative value of the wet suit is limited, and diving in cold waters results in discomfort, fatigue and added stress.

For enhanced comfort and safety, the "wet suit" is being replaced by the more expensive so-called "dry suit", which is designed to prevent water access next to at least a major portion of the diver's skin. The dry suit has a neck opening which may be sealed by pressure of a neck membrane against the diver's neck. Although some dry suits are configured to enclose all of the wearer's body except a hard hat, others may leave the hands and/or feet either exposed, or coverable by "wet" coverings or "dry" coverings such as e.g. soft soled "socks" or hard-soled "boots". Dry hand or foot coverings are configured to be sealed against leakage. Generally, entry into a dry suit is via an opening closable with an essentially water-tight zipper. Often, a dry suit for diving is configured to totally enclose the diver's feet, while non-footed dry suits may be more frequently used for water skiing, surfing, kayaking, etc.

Although the term "dry suit" generally refers to a suit used in water, similar suits are used to protect persons in other environments, i.e. to protect a person from exposure to hazardous materials (HAZ MAT suits) including chemical and biological materials. Similar wear is used by firemen as protection against exposure to heat, water, etc. In sterile, explosive, or "clean" environments , suits similar to "dry suits" are used to prevent contamination of the environment, or to prevent static electricity discharges by the entry of persons.

One of the problems with dry suits and similar apparel is that during use, perspiration and condensation become entrapped within the suit. Other moisture may be introduced into a dry suit by improper use of an exhaust valve or from inadvertent flooding, particularly in a diving situation. It is important to drain and wash the interior of a dry suit following use to remove perspiration and other contaminants. After a dive, commercial divers typically rinse the interior of the dry suit with an anti-fungicide, followed by three or four rinses with fresh water. However, the interior surfaces may remain wet for the next user, and may become malodorous and slimy.

With any suit whose interior is exposed to water, perspiration and/or other contaminants, removing the moisture quickly and completely after use is important to proper maintenance of the suit. Rapid drying (a) avoids growth of malodorous and destructive molds and bacteria, (b) prevents premature deterioration of the suit, and (c) permits comfortable subsequent use. A short drying time is not only necessary for cleanliness, suit preservation and wearer comfort, but increases the available use time as well. For example, donning a dry suit which has wet interior surfaces is very uncomfortable, and is counter to the purposes of a dry suit.

In order to simply drain water from a dry suit, the suit is typically hung head down on a commercially obtainable hanger. Use of such hangers does not readily permit removal of creases from the suit; instead, water typically remains trapped in the creases and takes a very long time to drain or evaporate. For this reason, it has been found very important to remove creases in the dry suit material.

At the present time, various hangers are available which suspend the dry suit from its ankles, for draining water through the neck and wrist openings. The hanger constricts the ankle portions of the suit, preventing passage of moisture from the foot spaces. Hanging a dry suit by the neck opening is also done, but the presence of major air-stagnant spaces in the legs and arms of the dry suit require much extended drying times. Expected drying times may be as short as a few hours in hot, dry climates, or as long as days. In humid areas, the drying time may be considerably longer, and the dry suit may never become fully dry. As already indicated, prior art hangers do not satisfactorily stretch the dry suit to remove wrinkles or creases, and water remains entrapped in the suit between creases.

Regardless of the position in which the dry suit is hung for drying, there is little if any air movement within the suit, and rapid growth of mold and bacteria ensues. In addition to the unpleasant odor, skin irritation and destructive nature of such growths to the dry suit, hazards to the health of the diver may also be presented.

Dry suits typically have stretchable seals at the neck and wrists and/or ankles which press against a diver's skin to substantially prevent the entry of water. These seals are typically formed of rubber or latex, and must be tight enough about the diver's neck and limbs to prevent water entry, yet not so tight as to cause vascular and respiratory restriction and/or panic (a life-threatening event in a diving situation). Once a seal is stretched, frequent use is required to maintain it in the stretched condition. Most dry suits purchased for recreational diving are used only a few times a year for a number of dives in quick succession. During intervening storage (months or years), the seals tend to return to their original un-stretched size. The neck seal, wrist seals and ankle seals of dry suits are typically pre-stretched by hand prior to each dive or dive series, or cut to size.

A large share of recreational diving (and subsequent suit drying) is done in geographical areas having high humidity, such as in or offshore the states of Florida and Washington. In such areas, rapid drying of diving suits using current procedures is nearly impossible.

The present invention is directed toward solving the above indicated problems associated with the use of dry suits, wet suits and other types of "exposure" suits which require drying or cleaning plus drying after being used.

Thus, it is an object of the present invention to provide a method and apparatus to remove interior moisture from an exposure suit in a very short time, to prevent the proliferation of fungi, bacteria, etc. and malodors associated therewith within the suit.

A further object of the invention is to provide methods and apparatus for conditioning and drying exposure suits for rapid turn-around use.

Another major object of the invention is to provide a method and means for initiating and maintaining the proper pre-stretched Ad size of neck seals, wrist seals and ankle seals of a e.g. dry suit.

An additional object of the invention is to provide apparatus and methods for cleaning and drying so-called "wet suits" commonly used for diving.

A further object is to provide drying apparatus which is portable, and which may be used in a boat or land vehicle.

BRIEF SUMMARY OF THE INVENTION

The invention comprises apparatus and methods for rapidly removing moisture from an "exposure" body suit such as a dry suit. While the invention is illustrated as being applied to a dry suit for diving, it may also be effectively used for drying any waterproof or water-resistant suit which has interior portions which cannot readily be opened to exposure to the ambient atmosphere. Examples of such varied applications of exposure suits, but not limited thereto, are those used for other water-based activities, for protection from hazardous (e.g. biohazardous) materials, for fire-fighting, and for processing of certain food, medicines or sensitive electronic equipment.

The dryer apparatus of this application may also be used for drying so-called "wet suits" as will become evident in the disclosure. This application is directed to interior drying of any exposure suit which may become wetted with water, perspiration, environmental contaminants and the like.

The invention is particularly illustrated herein in application to the drying of a dry suit for diving. The apparatus and methods described may be adapted to drying of any exposure suit; such adaptations are described herein.

In general, the invention includes apparatus for compressing relatively dry air, optionally warming the air and introducing the air at such a rate into an exposure suit that the slight superatmospheric pressure expands, inflates and un-creases the dry suit. The dry air passes over the wet interior surfaces to dry them. The particular use of each of the various non-limiting embodiments which are presented depends largely upon the suit configuration, as follows:

a. whether the suit material is impervious or non-impervious to airflow;
b. whether foot portions of the suit are integrally formed with the suit, or are open;
c. the type of seals at the neck, hand (and foot) openings; and other factors which will be described herein.

In this method, a stream of relatively dry warm air is (a) directed under pressure from a blower through an opening in the dry suit, (b) passed through each of the arms, legs and torso portions of the suit to absorb moisture, and (c) discharged from the suit at an increased dew point temperature. In general, the drying step is preferably preceded by washing or rinsing the dry suit with water, chemically treated water, or other material. A chemical may optionally be injected into the air stream to contact and treat the drying or dried inner surfaces. The drying time is relatively short, i.e. a matter of minutes rather than hours or days.

Various exemplary embodiments of methods and apparatus of the invention to treat and dry "dry suits" and other "exposure" suits are described hereinbelow.

When used in hot arid regions, warming of the ambient air may not be required to effectively dry the dry suit unless the suit is required to be completely dry in an extremely short time.

In addition, a method of this invention comprises the introduction of a chemical substance into the air stream to treat the interior of the dry suit. Such substances may comprise, for example, antifungal agents, antibacterial agents, and/or deodorants. The agents may be introduced into a liquid stream passed through the suit prior to rinsing and drying, or as a gas stream. An inert gas such as nitrogen may be passed through the dry suit. Optionally, and depending upon the resistance of the suit material to oxidation, an oxiding gas such as ozone may be used as an antibacterial/antifungal agent, passed through the suit for a short time period.

Various apparatus configurations for producing and conveying an air stream into a dry suit are shown and described. In a simple embodiment, a truncated conical neck insert may be tightly positioned in a neck seal opening, and a common hair dryer (modified to generate a higher pressure and an appropriate temperature) may be inserted into the neck insert to inject warm dry air. In another embodiment, a neck insert incorporates a blower (with optional heater) as an air source. In a preferred embodiment, a blower and heater upstream from the neck insert provide heated air. Optionally, the air may be introduced through a wrist insert or an ankle insert.

Another embodiment of the invention especially useful for simultaneously treating a plurality of dry suits comprises a permanent unit for heating, dehumidifying and pressurizing an air stream. The air is controllably distributed to a multi-duct bank for drying one or more dry suits simultaneously. The apparatus may include ducts to apparatus for dehumidifying, heating and recycling the wetted air or gas from the suits.

In a further embodiment of this invention, an air conduit is permanently integrally formed on/in the wall of the dry suit. A blower may be attached to the conduit for drying the dry suit. In still another embodiment, an attachment is provided for introducing a powder, liquid substance or gas into the air stream. In all cases, an insert is provided within each opening into the suit, i.e. wrist inserts, ankle inserts and/or neck insert. The insert(s) have openings for controlling the flow rate of "wet" air from each portion of the dry suit, and act to maintain a desired pressure within the dry suit. The apparatus may also be configured to pass a limited portion of the exit air through the neck insert.

The wrist inserts and neck insert are also useful to maintain properly stretched neck seal and wrist seals during prolonged storage.

The method and apparatus of the invention produce very rapid drying of the interior of a dry suit, enabling comfortable reuse in a short time, i.e. in generally less than about 0.4 hour, depending upon the humidity, temperature and flow rate of the drying air. The growth of deleterious mold and bacteria is prevented. The development of malodors is effectively prevented, and may be further avoided by the introduction of treatment agents into the drying air.

BRIEF DESCRIPTION OF THE DRAWINGS

The invention is illustrated in the following figures, wherein the elements are not necessarily shown to scale.

FIG. 13 is a partially cutaway top view of another embodiment of an insert in accordance with drying apparatus of the invention;

FIG. 14 is a partially cross-sectioned side view of another embodiment of an insert in accordance with drying apparatus of the invention, as taken along line 14—14 of FIG. 13;

DESCRIPTION OF THE ILLUSTRATED EMBODIMENTS

In this description, the term "exposure suit" will be used as being representative of body suits 10 to which the apparatus and method of the invention are directed. The term "exposure suit" is intended to include suits for diving (wet suits and dry suits), fire-fighting, handling toxic materials, "clean" suits, and the like.

Figure 1:
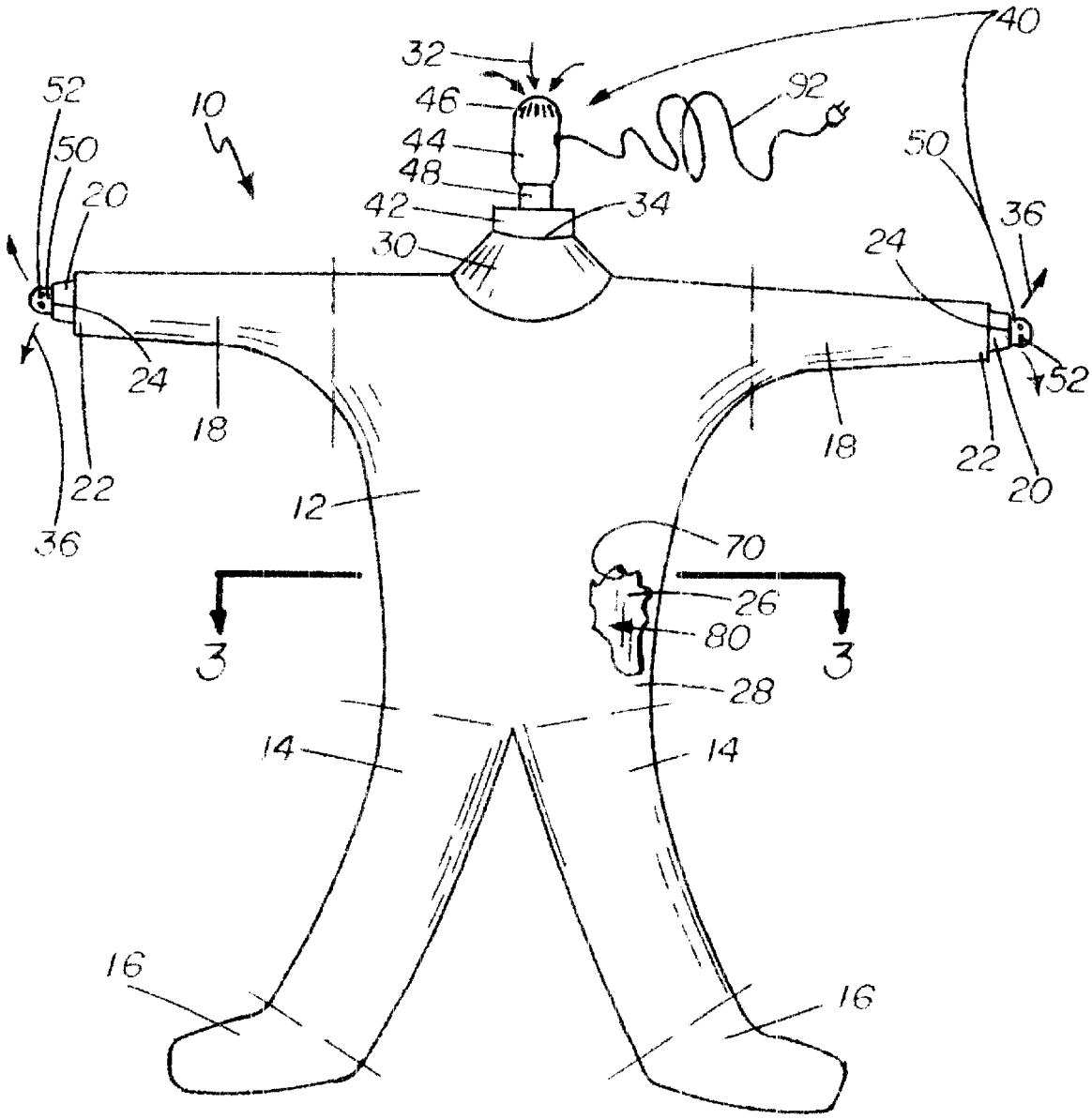
FIG. 1 is a generalized front view of a dry suit being dried by a dryer apparatus of the invention.
Figure 2:
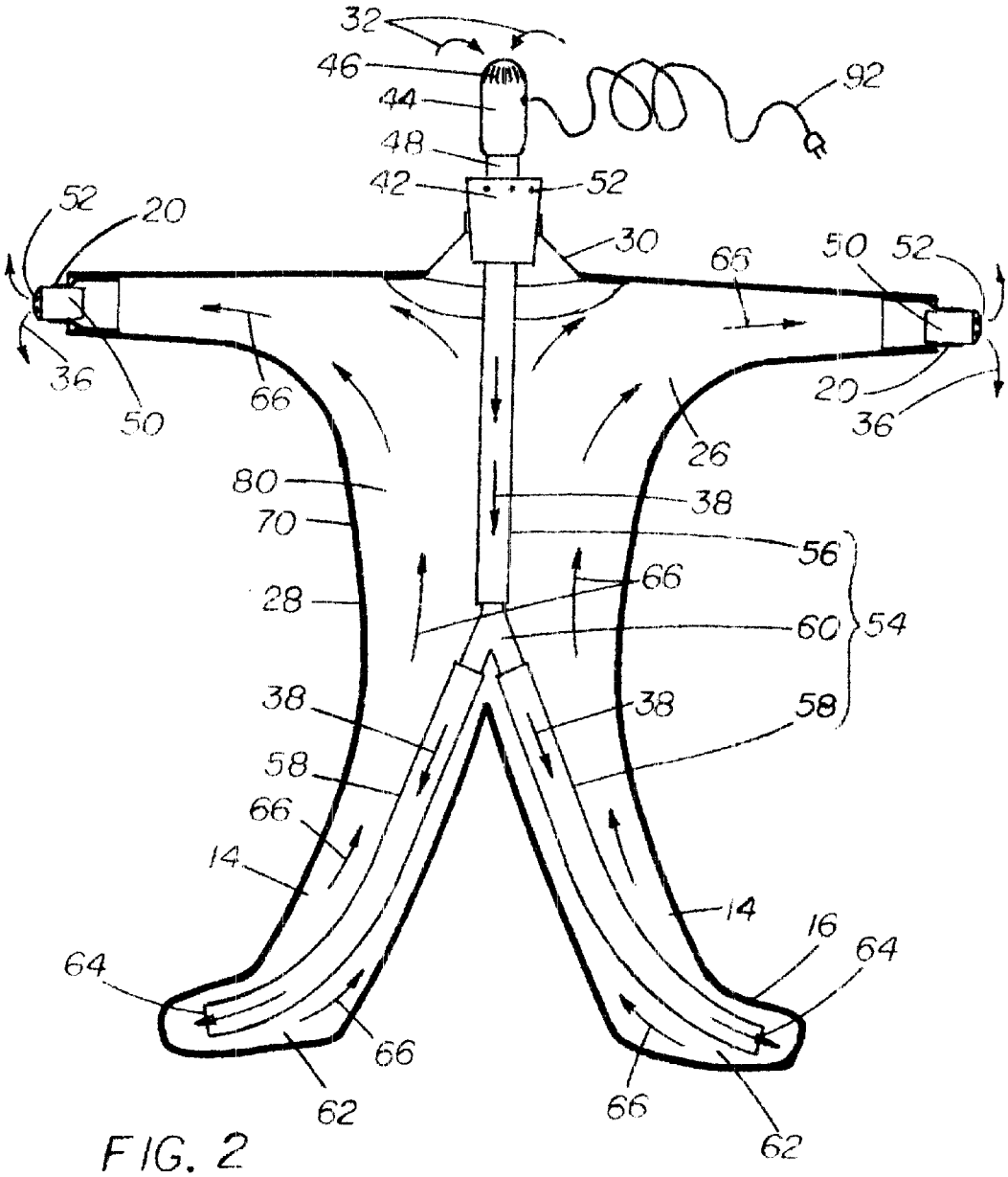
FIG. 2 is a cross-sectional front view of a dry suit having a dryer of the invention installed therein.
Figure 3:
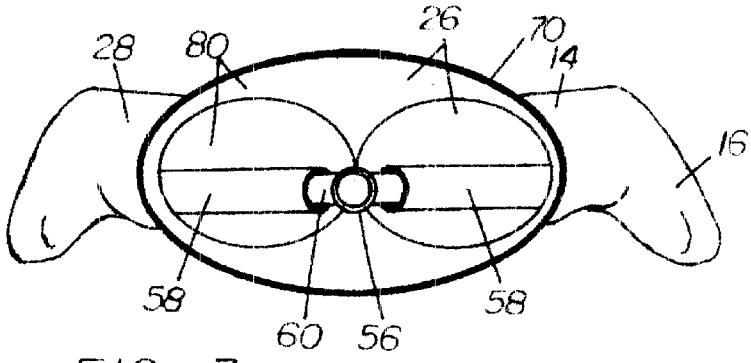
FIG. 3 is a cross-sectional top view through a torso portion of a dry suit and dryer of the invention, as taken along line 3—3 of FIG. 1.

As depicted in FIGS. 1, 2 and 3, a dry suit 10 is shown which represents a variety of dry suits manufactured and sold under several trade names, as well known in the art. The depicted dry suit 10 is intended to maintain a diver (e.g. SCUBA diver) dry while underwater. The dry suit 10 prevents the incursion of water into the suit by seals about a diver's neck and wrists. The typical dry suit for diving is formed of a water impermeable flexible material such as a nylon fabric coated with polyurethane or crushed neoprene, and has a torso portion 12, two leg portions 14, two foot portions 16 adjoining the leg portions, and two arm portions 18. In a common type of dry suit, the arm portions 18 terminate in arm cuffs 22 to which elastic wrist seals 20 are sealingly joined. Each wrist seal 20 has a wrist seal opening 24 through which a person's wrist may be passed. The unstretched size of each wrist seal opening 24 is such that circumferential stretching of the wrist seal 20 is required to accommodate a person's wrist. The wrist seal 20 is stretched sufficiently tightly about the wrist to seal the wrist seal opening 24 against the entry of water.

Dry suit 10 is also shown with an elastic neck seal 30 with a neck seal opening 34. The neck seal 30 must be of an elasticity or stretchability such that a person's head may be easily passed through the stretched neck seal opening 34, yet contract to sealingly compress against the person's neck to prevent entry of water into the dry suit 10.

It should be noted that some dry suits 10 utilize "hard" or rigid arm cuffs 22 to which separate dry "hand enclosures" 132 and/or foot enclosures 134 may be sealingly attached by a snap or turning motion. The methods and apparatus of the invention are adapted for the treatment and drying of such dry suits 10, as noted infra.

In FIGS. 1–3, the foot portions 16 of the particular dry suit 10 are shown as having no openings from the suit interior surface 26 to the suit exterior surface 28, i.e. from the suit's interior space 80 to the atmosphere. In other words, the user's feet are fully enclosed by the dry suit 10 without intermediate sealing joints. However, some dry suits 10 are terminated at the wearer's ankles, with ankle seals 114 (see FIG. 16) similar to wrist seals 20, for sealing against water entry about the ankles or legs. Similarly, the suit 10 may have hand enclosures, not shown in FIGS. 1–3, which may be sealably joined to the suit by wrist seals 20.

As shown herein, the present invention may be effectively adapted to a wide variety of dry suits 10, whether the suit is configured for the user's hands and/or feet to be (a) exposed, (b) enclosed by hand enclosures 132 and/or foot enclosures 134 which are connected to the suit at a separable joint, or (c) fully enclosed by arm portions 18 and/or foot portions 16 of the suit.

In this invention, it is important that a stream 38 of pressurized drying air passes through all portions of the suit 10 including the arm portions 18 and leg portions 14 as well as foot enclosures and hand enclosures, if attached to the suit. While even the circulation of unheated ambient air of 50+ percent relative humidity provides a great improvement over simply hanging the suit to dry in the atmosphere, circulation of air or gas which has a reduced relative humidity in accordance with this invention results in drying within a very much shortened time, e.g. less than an hour as compared to days of drying time. The actual drying time in this invention will depend upon the temperature and relative humidity of the drying air, air flow rate, and other factors.

Another important feature of this invention is the creation of a superatmospheric pressure within the body suit 10 to inflate and expand the suit, thereby removing creases.

During use, the wrist seals 20 and neck seal 30 (and leg seals if present) of a dry suit 10 must not be so tight as to significantly inhibit blood circulation or breathing, or to create panic. In particular, excessive compression of the neck seal 30 about a diver's neck could be fatal. Thus, the wrist seals 20 and neck seal 30 are generally formed of latex, rubber or neoprene and are configured to compress about the diver's neck, wrist or leg to effectively seal against water entry, without overcompression.

The dryer/treater apparatus 40 of the invention is used to dry the interior space 80 and interior surfaces 26 of a dry suit 10 following any activity which introduces moisture into the suit. Usually, dry suits 10 are washed or rinsed with water following use to remove perspiration and other contaminants from the interior surfaces 26 of the suits. Unless cleaned out and dried after use, a dry suit 10 is likely to become moldy and odorous.

In FIGS. 1 and 2, the dryer/treater apparatus 40 of the invention is shown as adapted to a dry suit 10 with wrist openings 24 with wrist seals 20 and fully enclosed foot spaces 62. As shown, a primary insert 42 tightly fits into the neck seal opening 34 and prevents significant gas leakage from the interior space 80 of the dry suit 10 (or conversely, into the dry suit) even when a pressure drop exists between the interior space 80 and the ambient atmosphere.

An air blower assembly 44 is shown with a power cord 92, and preferably has heating capability. The blower assembly 44 has air intake openings 46, and a blower outlet 48 which is attached to the primary insert 42, whereby incoming air 32 (typically ambient air) is compressed and blown as a stream 38 of pressurized drying air through blower outlet 48 into the dry suit 10. The stream 38 of pressurized drying air "inflates" the dry suit 10 to a relatively low positive pressure to flatten or remove any creases. As the pressurized drying air passes through suit 10 as a continuous stream 38, it absorbs moisture from the interior surfaces 26 of the suit. The air stream is continuously discharged as exhaust air 36 from the dry suit 10.

The low positive pressure in the interior space 80 of a dry suit 10 is controlled by one or more insert exhaust orifices 52 in the primary insert 42 and/or in the secondary inserts 50, the latter shown as fitting tightly in the wrist openings 24. Each secondary insert 50 has an insert exhaust orifice(es) 52 which is/are sized to restrict the flowrate of exhaust air 36 to a predetermined value which will achieve (a) a desired inflation pressure and (b) a desired air flowrate for drying. The primary insert 42, which is defined as the insert for entry of the stream 38 of pressurized drying air, may also have an insert exhaust orifice(s) 52 for discharging exhaust air 36. The sizes of the insert exhaust orifices 52, in combination, are configured to provide the desired flow rates of pressurized drying air 38 through each of the leg and arm portions 14, 18 and torso portion 12 of the dry suit 10, while simultaneously maintaining an appropriate internal suit pressure. As it passes through the moist dry suit 10, the stream 38 of pressurized drying air increases in moisture content, and its temperature is reduced by the energy required for evaporation.

The dryer/treater apparatus 40 is shown in more detail in FIGS. 2 and 3, and includes an air distribution system 54 for carrying the stream 38 of pressurized drying air to closed portions of the suit 10, i.e. the foot spaces 62 within the foot portions 16. The air distribution system 54 may comprise, for example, a unitary Y-shaped network of conduit of tubing or hose of about one-half inch to about 3 inch diameter, including a primary conduit 56 and secondary conduits 58 joined to the primary conduit by a hollow Y-connector 60. Conduits 56, 58 are formed of a material which will not corrode or otherwise deteriorate. The conduits 56, 58 may be rigid or semi-flexible, a preferred material being spiral flex tubing. Such spiral flex tubing formed of rubber or various polymeric materials is commercially available, for example, from Flexible Technologies, Inc. of Plymouth, Minn. This configuration is represented in FIG. 2.

Thus, in this embodiment, incoming air 32 is drawn into the blower assembly 44 through intake openings 46, optionally heated and passed in a continuous stream 38 of pressurized drying air through air distribution system 54 and discharged at each distal end 64 thereof. The discharged streams of drying air 66, which includes portions thereof within each foot space 62 and leg portion 14, pass toward the insert exhaust orifices 52 in the primary insert 42 and/or secondary inserts 50, absorbing moisture en route, and are exhausted therefrom. In this manner, drying air passes over all interior surfaces 26 of the dry suit 10 to achieve rapid drying thereof.

Figure 3B:
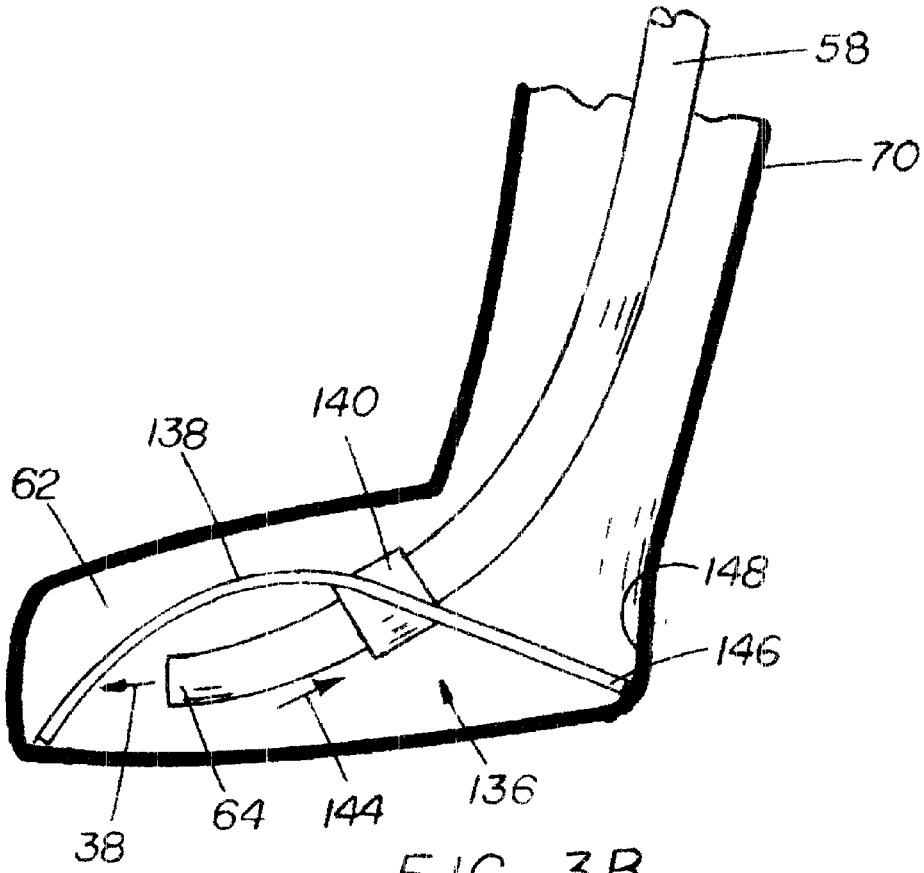
FIG. 3B is a cross-sectional side view through a foot portion of a dry suit showing a conduit secured by a conduit securer of the invention.
Figure 3A:
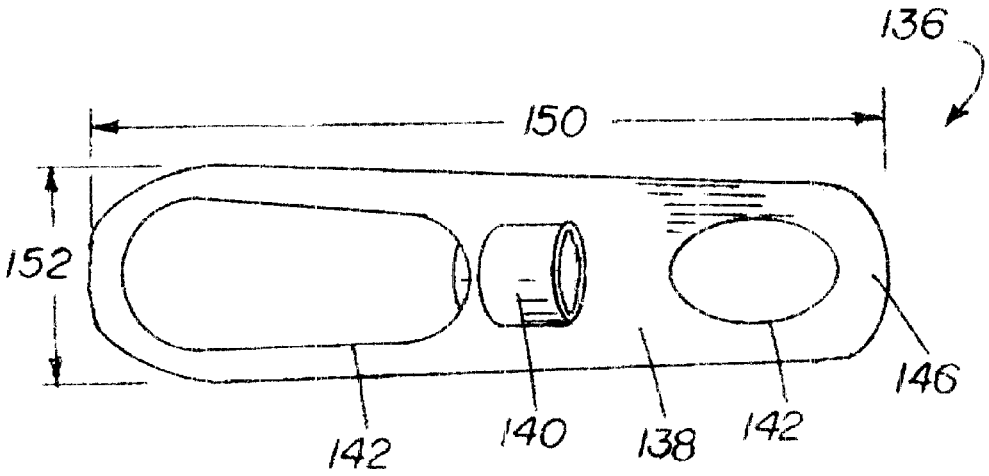
FIG. 3A is a top view of an exemplary conduit securer of the invention.

If the secondary conduits 58 (FIGS. 2 and 3) have insufficient rigidity to maintain their distal ends 64 thereof within the terminal spaces of the limbs, e.g. foot spaces 62, the distal ends 64 may be retained within the foot spaces by weights, not shown, or by conduit retainers 136 such as that illustrated in FIGS. 3A and 3B. In this embodiment, conduit retainer 136 comprises a smoothly finished resilient plastic retainer body 138 with a ferrule 140 angularly formed in the retainer body 138. The retainer body 138 has a length 150 and width 152 whereby it easily fits within the foot space 62. The retainer body 138 is shown with open spaces 142 therethrough to enhance air circulation throughout the foot space 62. The distal end 64 of the secondary conduit 58 is passed through the ferrule 140 and retained thereby. When the stream 38 of pressurized drying air stream passes from the secondary conduit 58 as discharged pressurized drying air 66, any reactionary force 144 tending to move the conduit 58 from the foot space 62 forces the rear end 146 of the retainer 136 against the inner heel surface 148 of the suit 10, retaining the conduit within the foot space 62.

Figure 21:
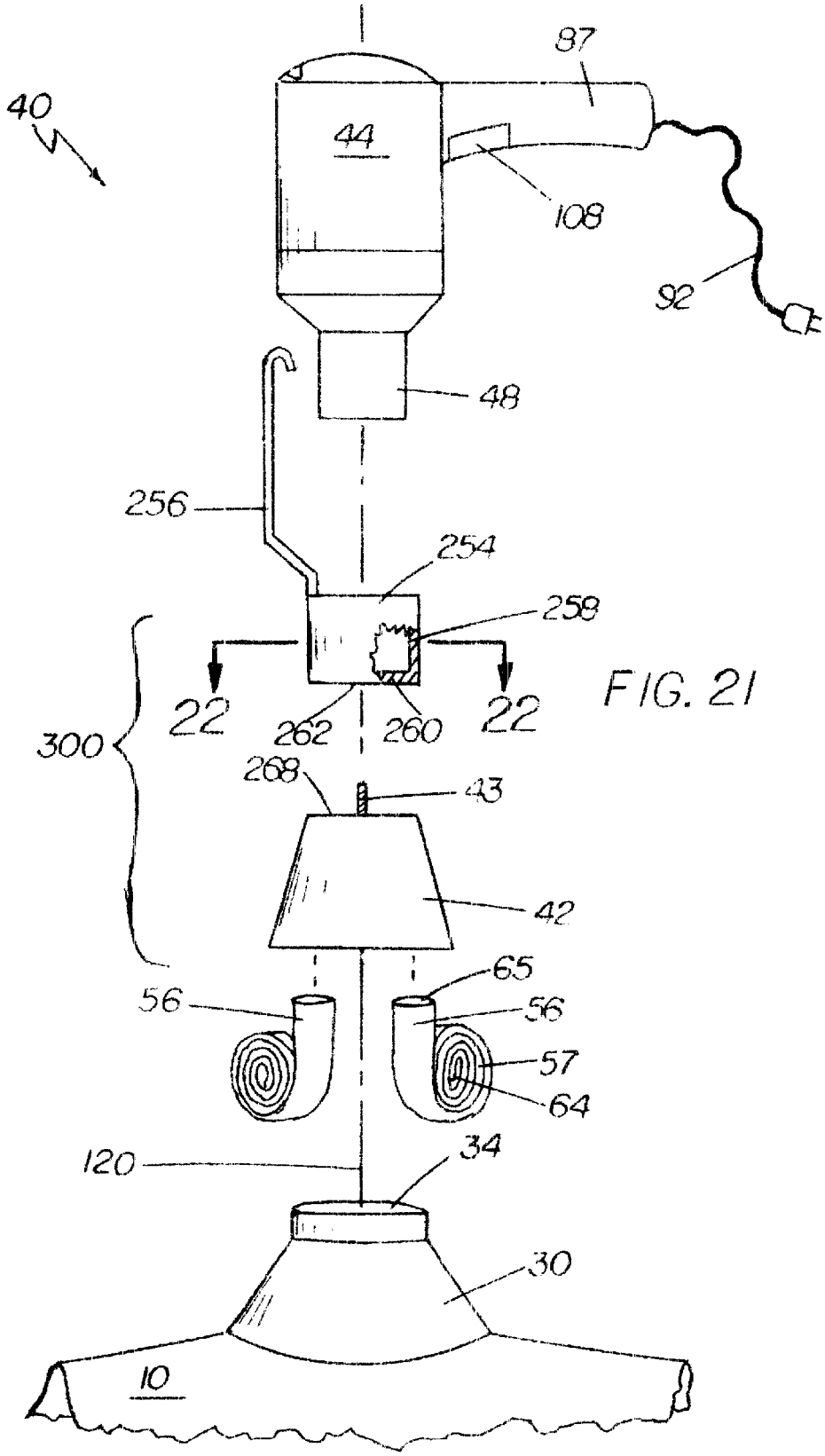
FIG. 21 is a front exploded view of a further drying apparatus of the invention.
Figure 22:
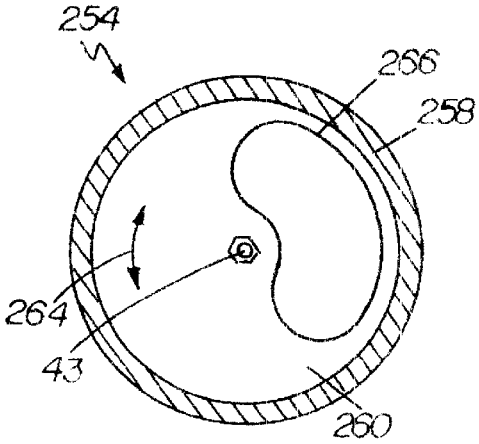
FIG. 22 is a cross-sectional view of a portion of a drying apparatus of the invention.
Figure 23:
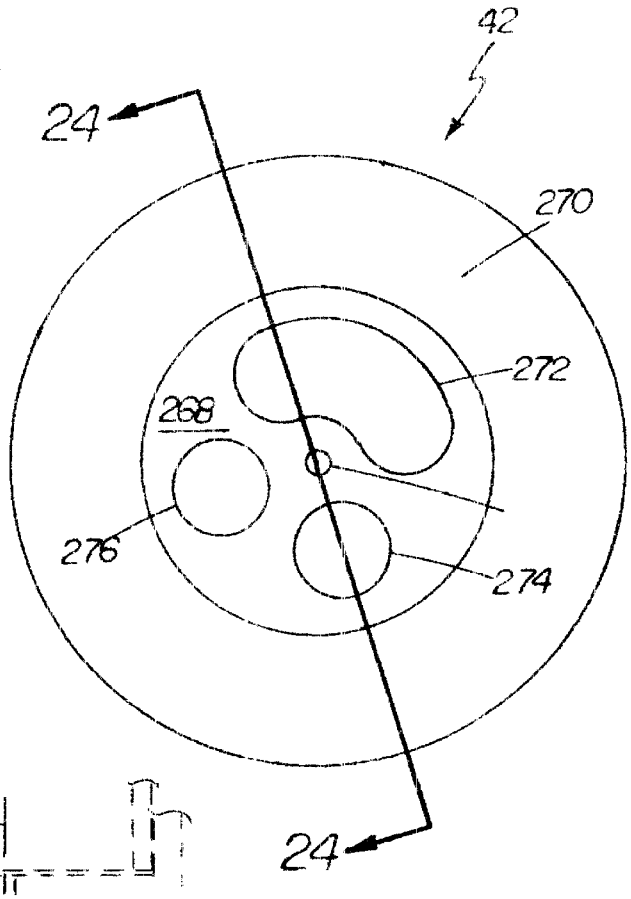
FIG. 23 is an upper view of another embodiment of a neck insert of a drying apparatus of the invention.
Figure 24:
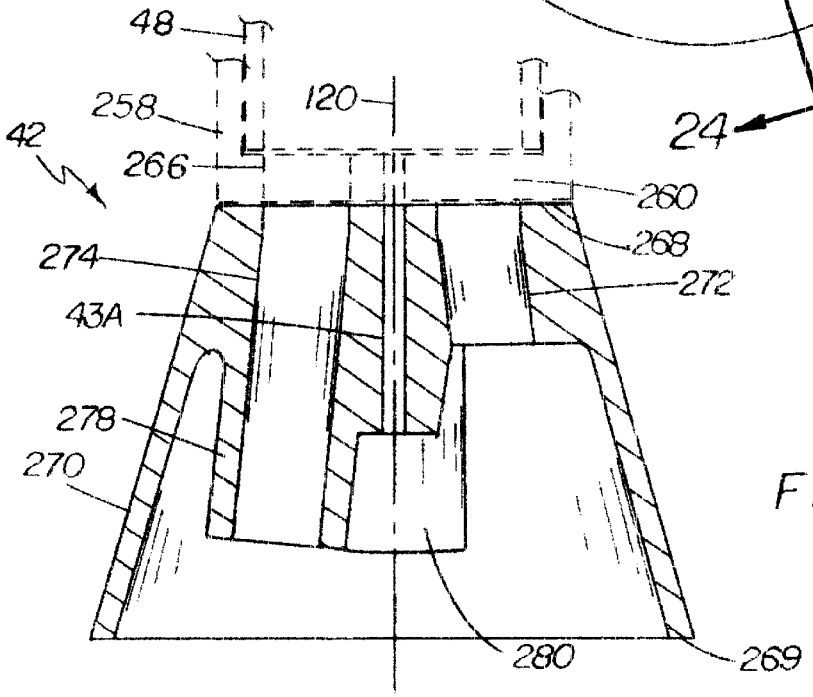
FIG. 24 is a cross-sectional side view of a neck insert of a drying apparatus of the invention, as taken along line 24—24 of FIG. 23.

In a further embodiment, the secondary conduits 58 are formed of auto-expanding members as illustrated in FIG. 21.

Figure 4:
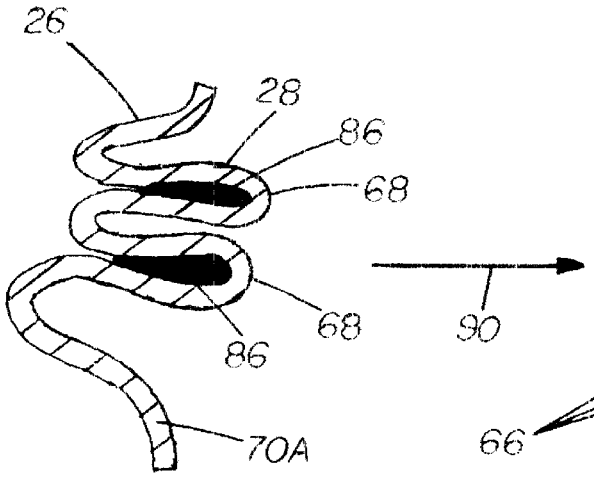
FIG. 4 is a cross-sectional view through the fabric of a dry suit dryer prior to inflation in a drying process in accordance with the invention.
Figure 4A:
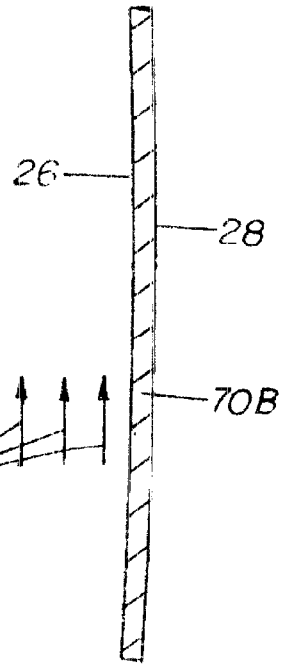
FIG. 4A is a cross-sectional view through the fabric of an exposure suit following inflation during a drying process in accordance with the invention.

During the drying process, the air pressure within the dry suit 10 is maintained so that the dry suit 10 is in a somewhat "inflated" or expanded state. In the uninflated state shown in FIG. 4, wall 70A has creases 68 which trap water 86 along the suit's interior surfaces 26. The inflation process 90 expands the dry suit 10 to form a generally creaseless wall 70B as shown in FIG. 4A. Thus all of the interior surfaces 26 of the dry suit 10 may be readily drained, and are exposed to the drying air stream 66.

For the most effective drying, the stream 38 of pressurized drying air from the blower assembly 44 should have a low relative humidity. Thus, a heating element 88 may be incorporated into the blower assembly 44 for use when ambient air is too humid (high dew point) for effective drying. When diving in arid areas, where the ambient air has a low dew point temperature, heating of the incoming air 32 may not be necessary.

During the drying process, the exhaust air 36 may initially be at a temperature much lower than the temperature of incoming air 32, and of a much greater humidity. Of course, as drying proceeds toward a completely dry condition, the moisture content of the exhaust air 36 will approach the moisture content of the incoming air 32. When drying is completed, the absolute humidity and dew point of the incoming air 32 and exhaust air 36 will be identical.

Figure 25:
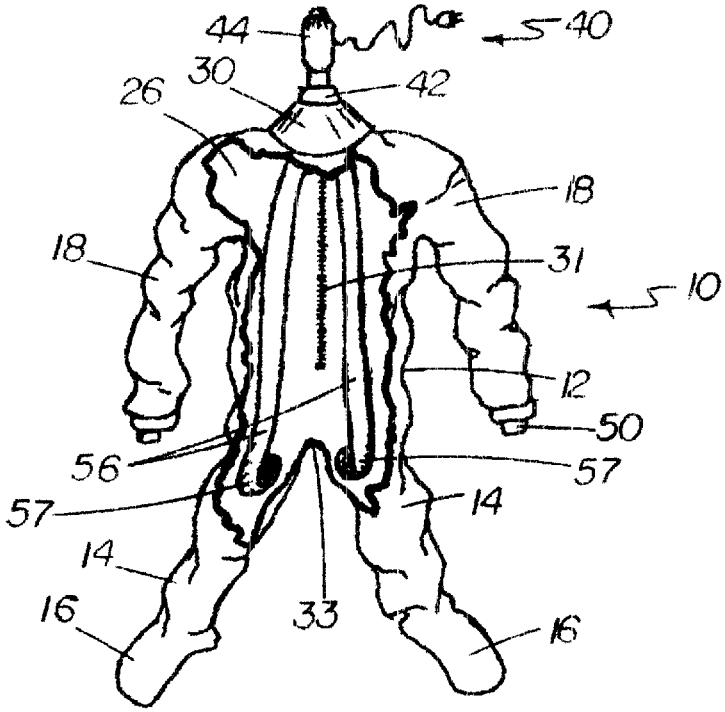
FIGS. 25, 26, 27 and 28 are partially cut-away front views of a dry suit and attached drying apparatus, showing steps in drying the interior of the dry suit.
Figure 26:
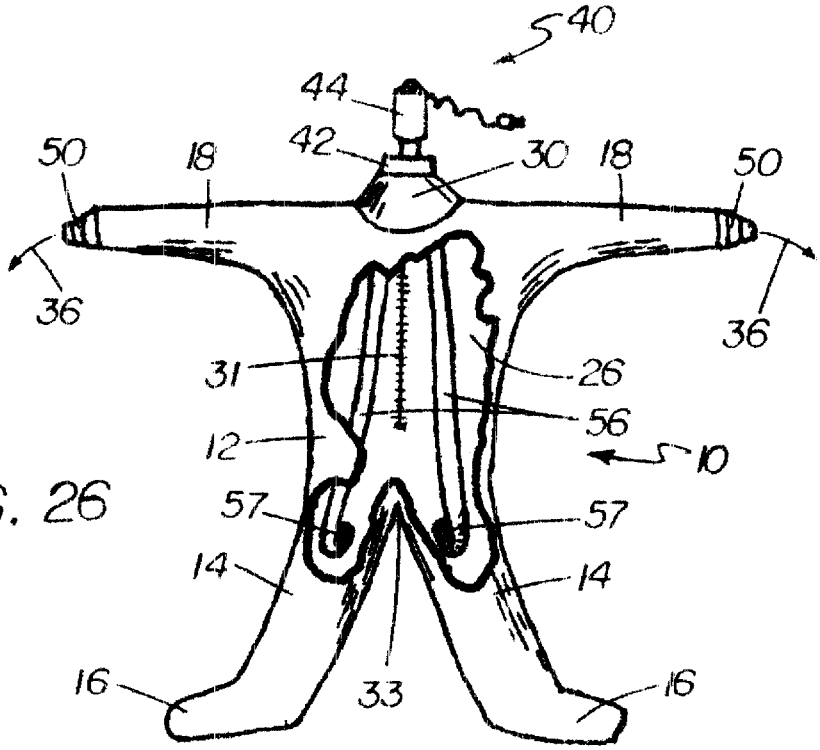

The pressure required within the interior space 80 of a dry suit 10 will vary, depending upon the weight, rigidity, and crease tendency of the dry suit wall 70, as well as the composition of the seals and closure zippers 31 (see FIG. 25). The pressure drop in the air distribution system 54 is relatively small so that an effective air flow rate may be maintained without a high air pressure of air stream 38 at the blower outlet 48. Using a well-known dry suit made by USIA of St. Helens, Ore., it was found that an internal pressure of about one inch water column (about 0.036 psi) sufficiently expanded the dry suit to remove wrinkles and effectively "inflate" the suit. While not all available dry suits 10 have been tested, it would appear that an effective interior pressure may range from about 0.5 inch water to about 6 inches water (about 0.018 to about 0.22 psi), depending upon the particular suit. Other types of body suits made of lightweight material may become sufficiently inflated at lower pressures. Other types of body suits 10 with heavy walls may require internal pressures up to about 27 inches water column (about 1 psi). Certain suits which are formed of an air-permeable material (such as a diving wet suit) may require a relatively high air flow to maintain a state of inflation at a relatively low positive pressure.

Figure 5:
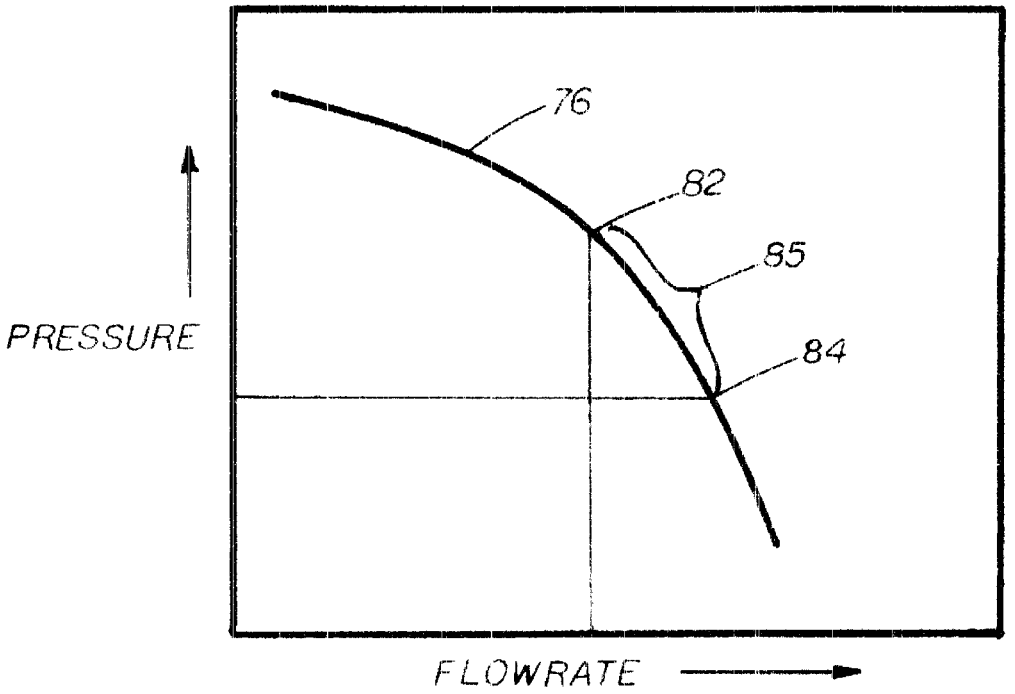
FIG. 5 is a generalized chart of the flow-pressure output characteristics of a blower drying an exposure suit in accordance with the invention.

As depicted in FIG. 5, the regressive flow/pressure curve 76 of a theoretical blower fan design is shown. The curve 76 exceeds the design conditions anywhere between minimum desired operating flowrate 82 and minimum desired operating pressure 84, this pressure range 85 comprising a desired operating range for the blower assembly 44. The air distribution system and the secondary inserts of any of the embodiments described herein are designed to provide the desired pressure drop which will provide operation of the blower assembly 44 within pressure range 85. Of course, as the blower output at desired pressure increases, the orifice sizes of the inserts are made larger.

Figure 6:
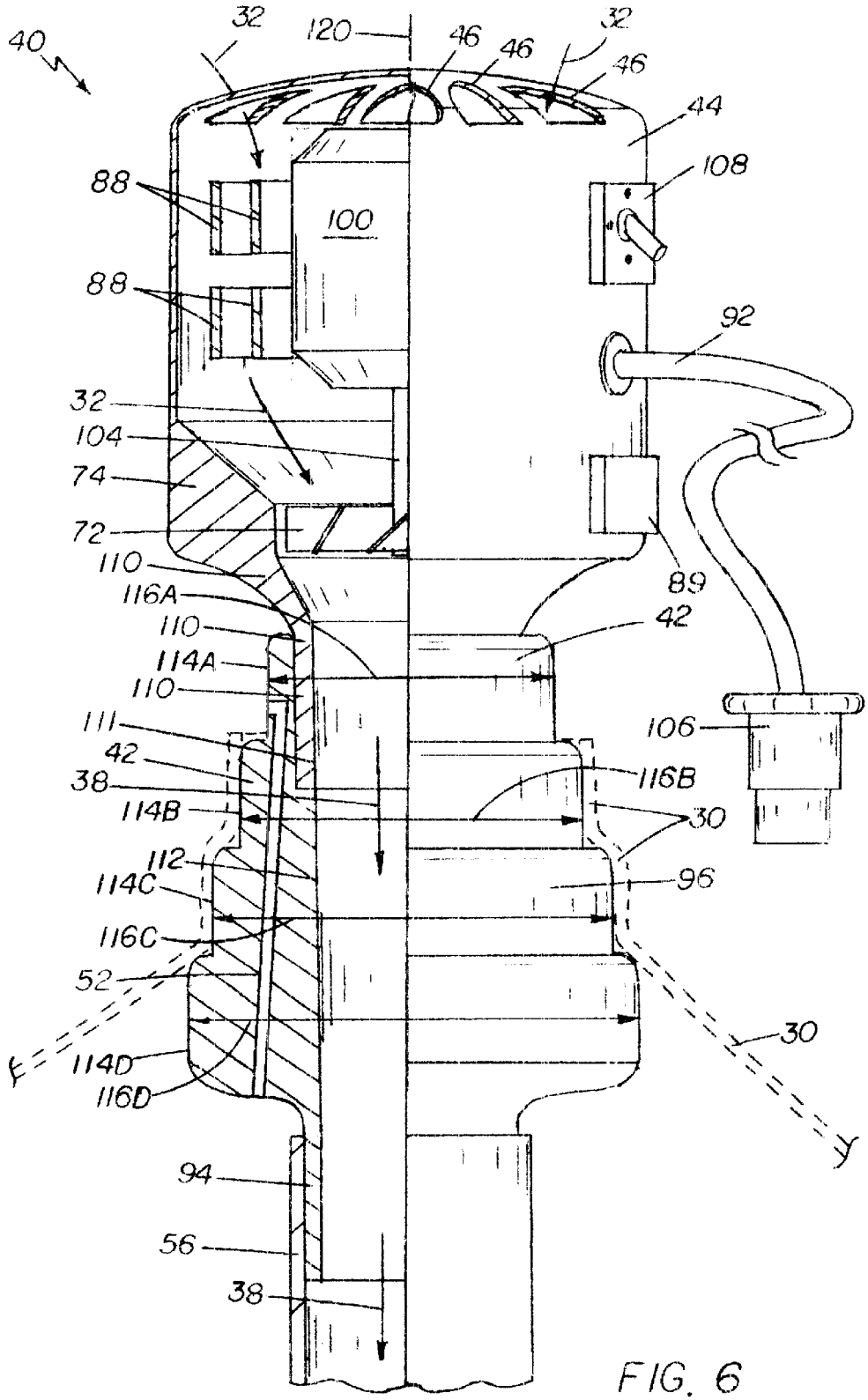
FIG. 6 is a partially sectioned side view of a portion of a dry suit dryer in accordance with the invention.

FIG. 6 illustrates an exemplary embodiment of the dryer/treater apparatus 40 with center line 120; the left side of the drawing is cross-sectioned through external portions of the dryer/treater apparatus 40 for clarity.

As depicted in FIG. 6, a dryer/treater apparatus 40 of the invention includes a blower assembly 44 with a fan 72 housed in fan housing 74 and driven by motor 100 through drive shaft 104. The motor 100 is mounted in the fan housing 74. One or more heating elements 88 are mounted in the fan housing 74 to heat the ambient incoming air 32 to a temperature above ambient, generally by about 20 to about 40 degrees F. Preferably, the incoming air 32 is heated to about 90 to 140 degrees F. The temperature must be less than that which will cause the dry suit wall 70, neck seal 30, wrist seals 20, and ankle seals 98 to deteriorate or permanently change in flexibility. An overheat sensor/cutoff switch 89 may be included to prevent the air temperature from exceeding a preset temperature.

As shown in FIG. 6, the power cord 92 is connected to a power plug 106 for use in a 12 volt DC vehicle or marine outlet, not shown. Thus, for example, the apparatus may use battery power of a boat, automobile, truck or recreational vehicle. In this case the motor 100 and heating elements 88 are configured for 12 volt DC power. If drying is to be performed where 120 volt AC power, 240 volt AC power or other power source is available, the power plug 106 may include a transformer and rectifier to convert the higher AC voltage to standard 12 volt DC. A power supply device may be used to optionally use either standard 12 volt DC, or transform AC power to 12 volt DC, so that the dryer/treater apparatus 40 may be used in a variety of venues.

FIG. 6 shows a switch 108 for turning ON the fan motor 100 only, or the fan motor 100 together with the heating element(s) 88.

The blower assembly 44 includes intake openings 46 by which intake ambient air 32 may be drawn by fan 72 past the heating elements 88 and discharged from fan housing outlet 110 through air duct 111 as stream 38 of pressurized drying air whose actual temperature is significantly higher than its dew point temperature.

The blower assembly 44 is mounted on, i.e. attached to a primary insert 42 with an internal duct 112 for directing the pressurized (and preferably heated) air stream 38 to the primary conduit 56. The primary insert 42 is shown with external concentric steps 114A, 114B, 114C and 114D with progressively increasing diameter 116A, 116B, 116C and 116D, respectively, about centerline axis 120. In the example of FIG. 6, the primary insert 42 is shown as inserted into a dry suit neck seal 30 so that the neck seal opening 34 is stretched to the step diameter 116 of step 114B, this stretching providing the desired neck seal opening and retaining the design pressure within the dry suit 10. The primary insert 42 has an outlet end 94 to which the primary conduit 56 is attached. As described above, the compressed (and preferably heated) air stream passes through the primary conduit 56, is divided by a Y-connector 60 into two streams, each of which passes through a leg (or secondary) conduit 58 to a foot space 62.

Where the conduit 58 has outer surfaces e.g. rubber which will adhere to the interior rubber surfaces 26 of a suit 10, the conduit may be covered by a cloth e.g. open mesh nylon stocking, not shown, to ease entry of the conduit through a leg portion 14.

In a further embodiment as discussed, infra, each of two primary conduits 56 may be insertable through a leg portion 14, thus eliminating the Y-connector 60.

Figure 3C:
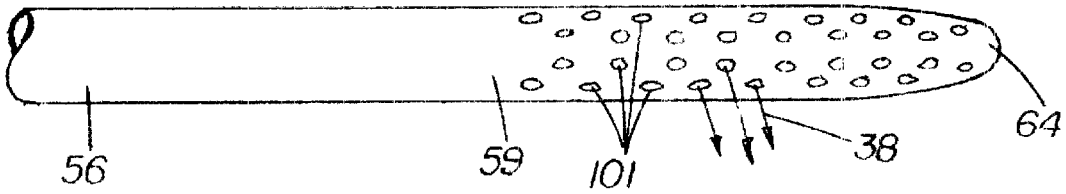
FIG. 3C is a side view of an end portion of an air carrying conduit of a dryer of the invention.

While the distal discharge ends 64 of the conduits are shown in FIGS. 2 and 3B as being fully open, other configurations are possible. For example, in FIG. 3C, the discharge end 64 of a conduit 56 or 58 is shown as being closed, but with a pattern of openings 101 through the conduit wall 59 through which pressurized drying air 38 is introduced into the suit.

Figure 3D:
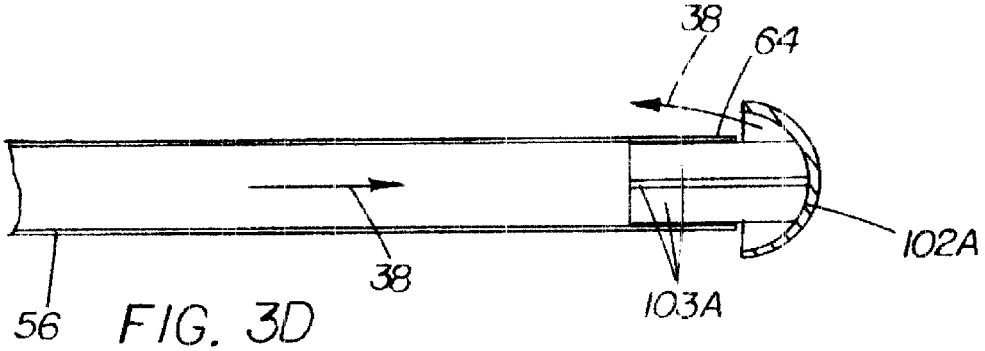
FIG. 3D is a cross-sectional side view of an air deflection device for attachment to air conduits of an exposure suit dryer of the invention.
Figure 3E:
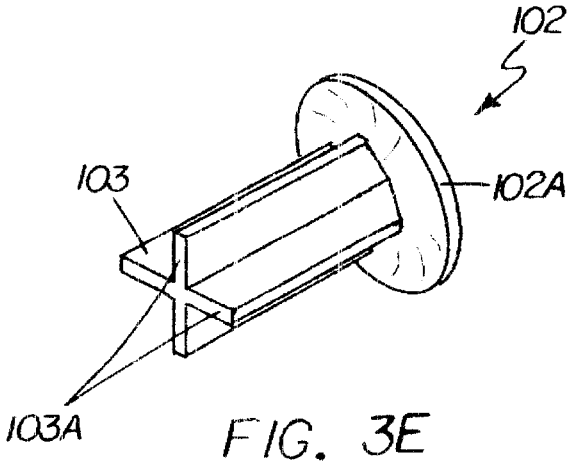
FIG. 3E is a perspective view of an air deflection device of an exposure suit dryer of the invention.

In FIGS. 3D and 3E, pressurized drying air 38 is shown as being deflected outward at the discharge end 64 by a device 102 comprising a deflector 102A having its concave side 102B attached to an insertion end 103 formed of crossed vanes 103A. The insertion end 103 is tightly insertable in end 64 of the conduit 56 or 58, i.e. whichever comprises the air discharge end. The device 102 is preferably formed of plastic. Use of the deflector device 102 reduces the counterforce tending to push a very flexible conduit from a leg portion 14 or arm portion 18.

The fan housing outlet 110 may be joined to the primary insert 42 by cementation, screws, matching threads, latches, or other means including a slip-fit joint, any of which may be used to maintain them rigidly together and prevent air leakage therefrom. If desired, the fan housing 74 and primary insert 42 may be formed as an integral unit.

As shown in FIG. 6, one or more insert exhaust orifices 52 may be incorporated in the primary insert 42 for passage of exhaust air from the dry suit 10.

Figure 7:
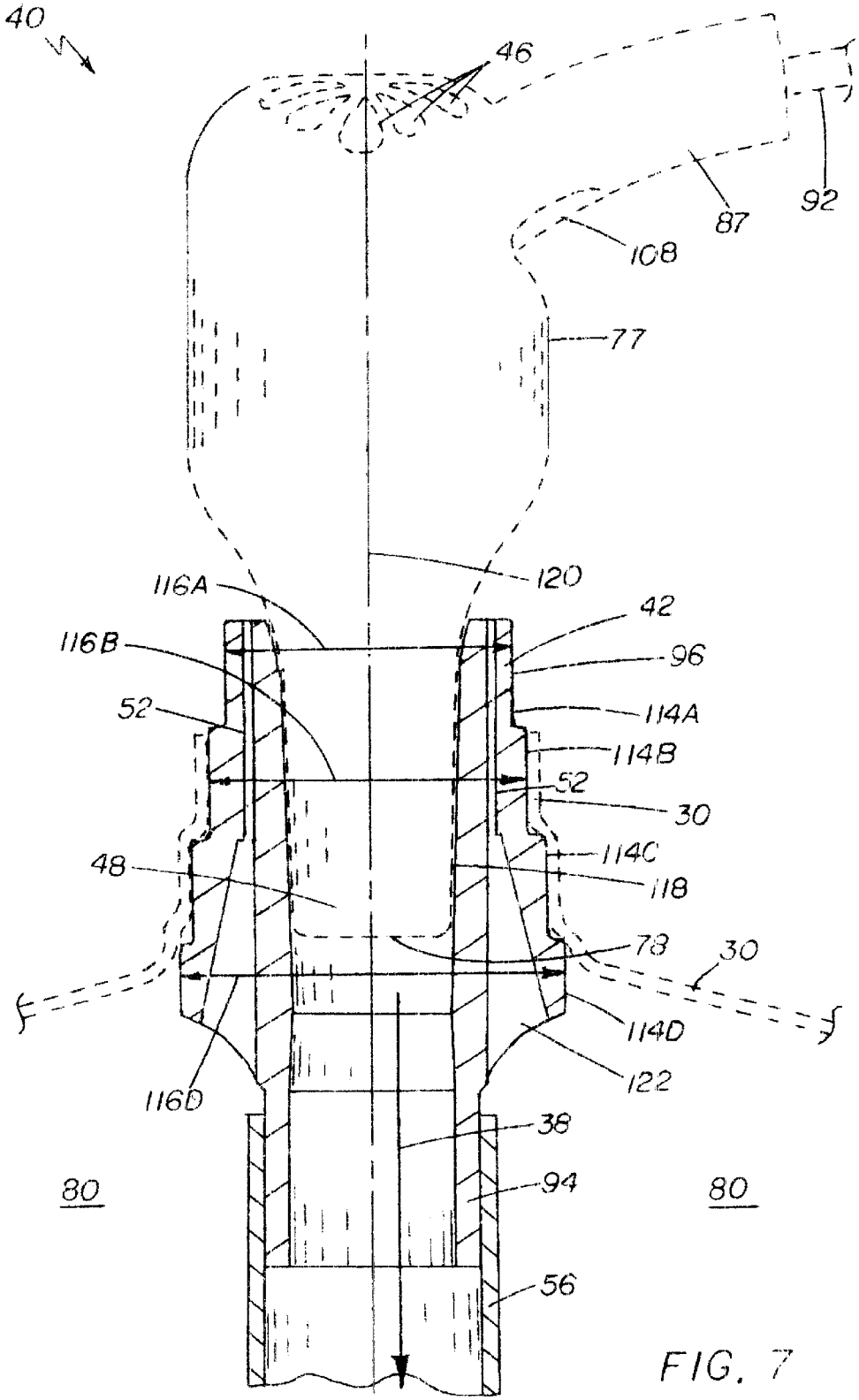
FIG. 7 is a cross-sectional side view of a portion of a dry suit dryer in accordance with another embodiment of the invention.

The drying/treating apparatus 40 may be configured to use a commercially available hair dryer 77 to produce warmed compressed air. As shown in FIG. 7, such an apparatus 40 may include a primary insert 42 which has an opening 118 adapted to receive the outlet end 78 of a commercially available hair dryer 77, as well as insert exhaust orifices 52 for passage of air from the suit interior space 80. Many commercially available hair dryers 77 produce insufficient pressure to adequately inflate a dry suit 10, however, and such are ineffective for extended use without increasing the motor horsepower and matching an appropriate fan 72 thereto.

As shown in FIG. 7, the primary insert 42 has an exterior surface 96 which has a series of steps 114A, 114B, 114C, and 114D of increasing diameter 116A, 116B, 116C, and 116D. A neck seal 30 is shown stretched over the step 114B, which stretches and retains the neck seal at diameter 116B.

Commercially available hair dryers 77 have control switches 108 and are typically configured to use 110 volt AC power. Thus, they are readily usable where AC power is available, or with an electric inverter.

The progressive diameter 116 feature of primary inserts 42 and secondary inserts 50 may take various forms, including the following:

(a) a plurality of steps 114 of increasing diameter, each step uniformly at one diameter;

(b) a plurality of steps 114, but each step tapering at an angle of up to about 30 degrees from a low diameter to a high diameter, the low diameter of a subsequent step being greater than the high diameter of a prior step; and (c) a simple stepless conical taper from a low diameter to a high diameter, where the stretching diameter may have any value between the low diameter and the high diameter.

The primary and secondary inserts 42, 50 may be formed of plastic, metal or rubber, for example. If formed by molding, the inserts 42, 50 may include spaces 122 (see FIG. 7) to reduce the weight and quantity of material used.

The air pressure which inflates the dry suit 10 is generally controlled by insert exhaust orifices 52 in the secondary inserts 50 as well as the primary insert 42. It should be noted that in a preferred embodiment of the invention, all the existing entryways, including neck seal opening 34 , wrist seal openings 24 and/or ankle seal openings 154, are substantially closed with inserts 42, 50, but each insert may have an exhaust orifice for discharging humidified air. A primary insert(s) 42 through which air is introduced may be installed in any of the openings 34, 24 or 154, and secondary inserts 50 installed in the remaining openings for controlled exhausting of humidified air. FIGS. 8, 9, 10, 11, 12, 13, 13A, 13B, and 14 show various configurations of secondary inserts 50 which may be used. Typically, the primary insert 42 may utilize any of the single step or multi-step features depicted in these figures. The general configuration of a primary insert will be considered to be effectively truncated conical.

Like the primary insert 42 shown in FIGS. 6 and 7, the secondary inserts 50 may provide a range of step diameters 116 over which a wrist, ankle or neck seal 20, 30 or 98 of a particular seal opening diameter 124 will be stretched.

Figure 8:
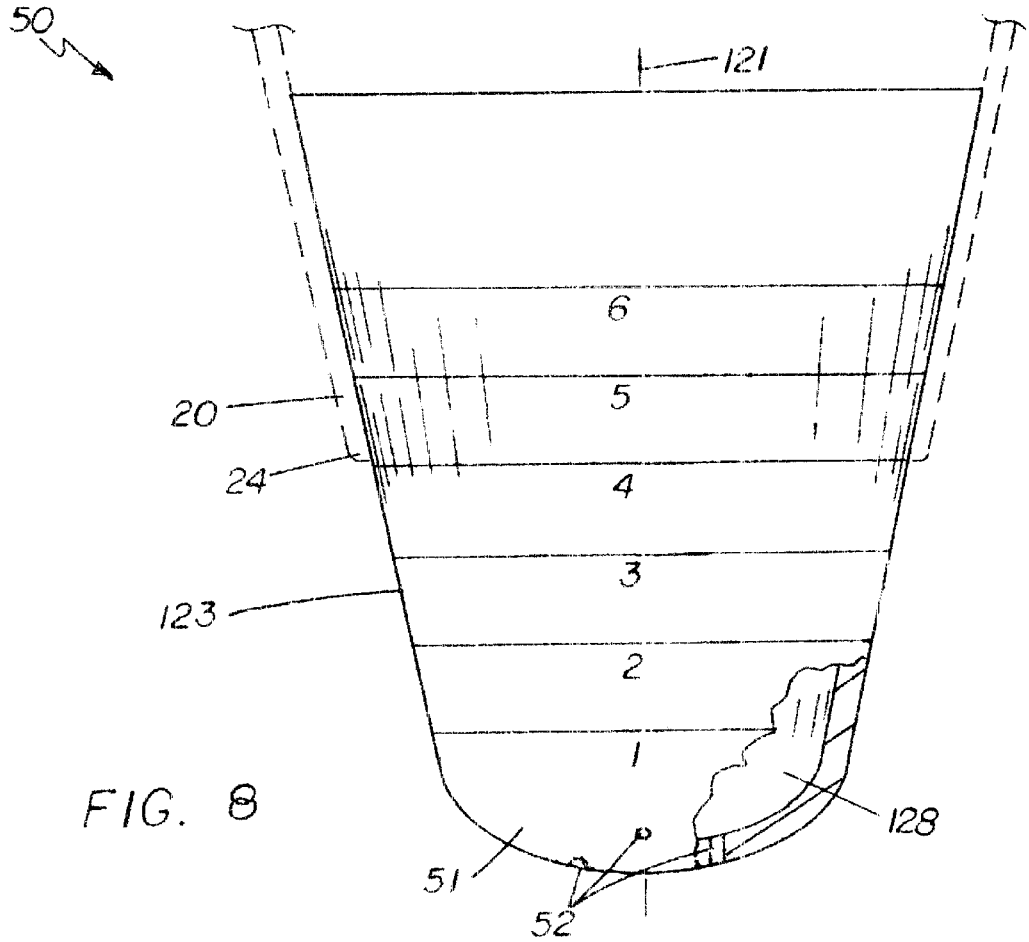
FIG. 8 is a side view of an insert in accordance with drying apparatus of the invention.
Figure 9:
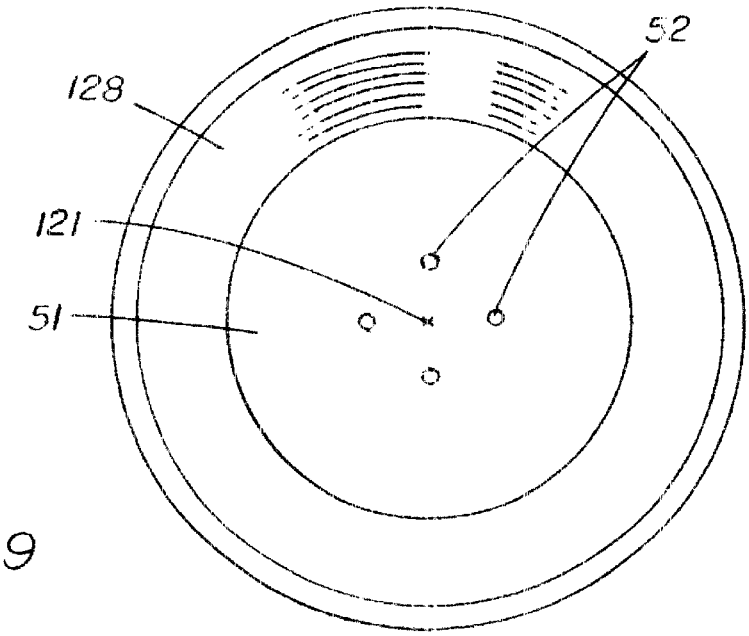
FIG. 9 is a top view of an insert in accordance with drying apparatus of the invention.

FIGS. 8 and 9 show a secondary insert 50 with an outside stepless conical surface 123 about central axis 121. The inside of the secondary insert 50 is hollow with interior surface 128. The outside diameter, i.e. size is indicated by numbers on the secondary insert 50 which correspond to wrist size, for ease of installation. A wrist seal 20 with wrist opening 24 is shown stretched on secondary insert 50 to a scaled size between 4 and 5.

The closed end 51 of secondary insert 50 has one or more insert exhaust orifices 52 which, together with orifices 52 in other inserts 42, 50 provide the desired pressure drop from the suit interior space 80 to exterior of the suit exterior surface 28 (i.e. ambient). The total flow area (of both secondary inserts 50) which is required will depend on the blower operating characteristics and can be calculated using straightforward engineering principles. Alternatively, it may be determined experimentally. For example, inserts having multiple insert exhaust orifices 52 may have orifices plugged one by one until the desired pressure is achieved. It can be seen, of course, that many devices enabling variable air flow rates may alternatively be used, including spring biased valves configured to open at a given pressure. For most purposes, however, use of the flow friction of orifices 52 provides a sufficiently precise pressure over a range of flowrates.

Figure 10:
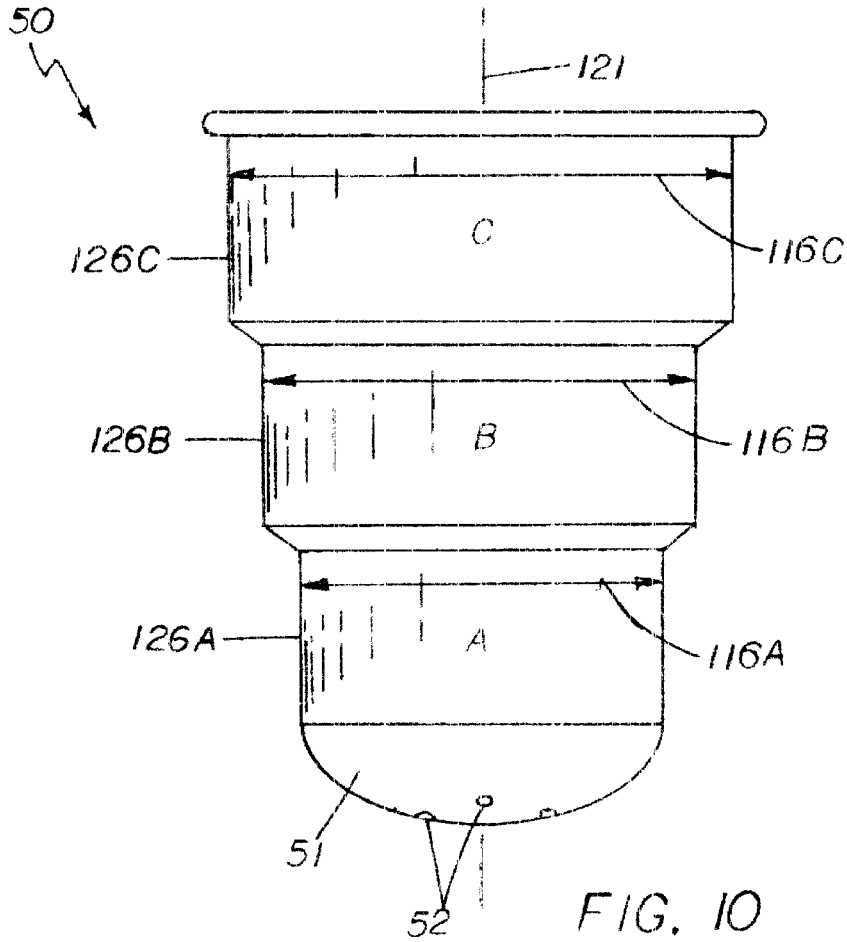
FIG. 10 is a side view of another embodiment of an insert in accordance with a drying apparatus of the invention.
Figure 11:
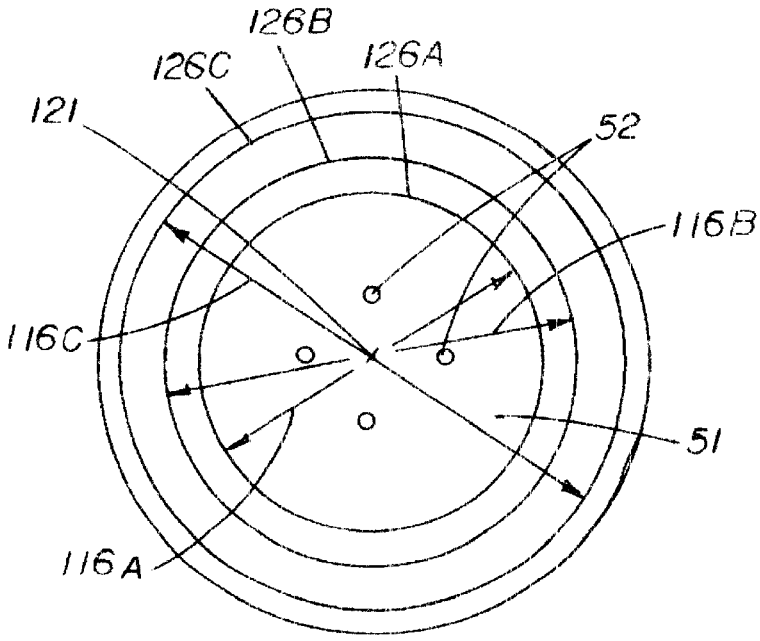
FIG. 11 is a bottom view of another embodiment of an insert in accordance with drying apparatus of the invention.

FIGS. 10 and 11 illustrate a secondary insert 50 with three steps 126A, 126B and 126C of differing diameters 116A, 116B and 116C, respectively. As shown, an indication of the diameter 116 may be indicated on the step for ease of installation. In this case, the diameter size is indicated by a letter A, B, C, etc.

The closed end 51 of secondary insert 50 has one or more insert exhaust orifices 52 whose total open flow area provide the desired pressure drop and gas flow rate from the suit interior space 80 to the suit exterior 28 (ambient), with the particular fan used.

Figure 12:
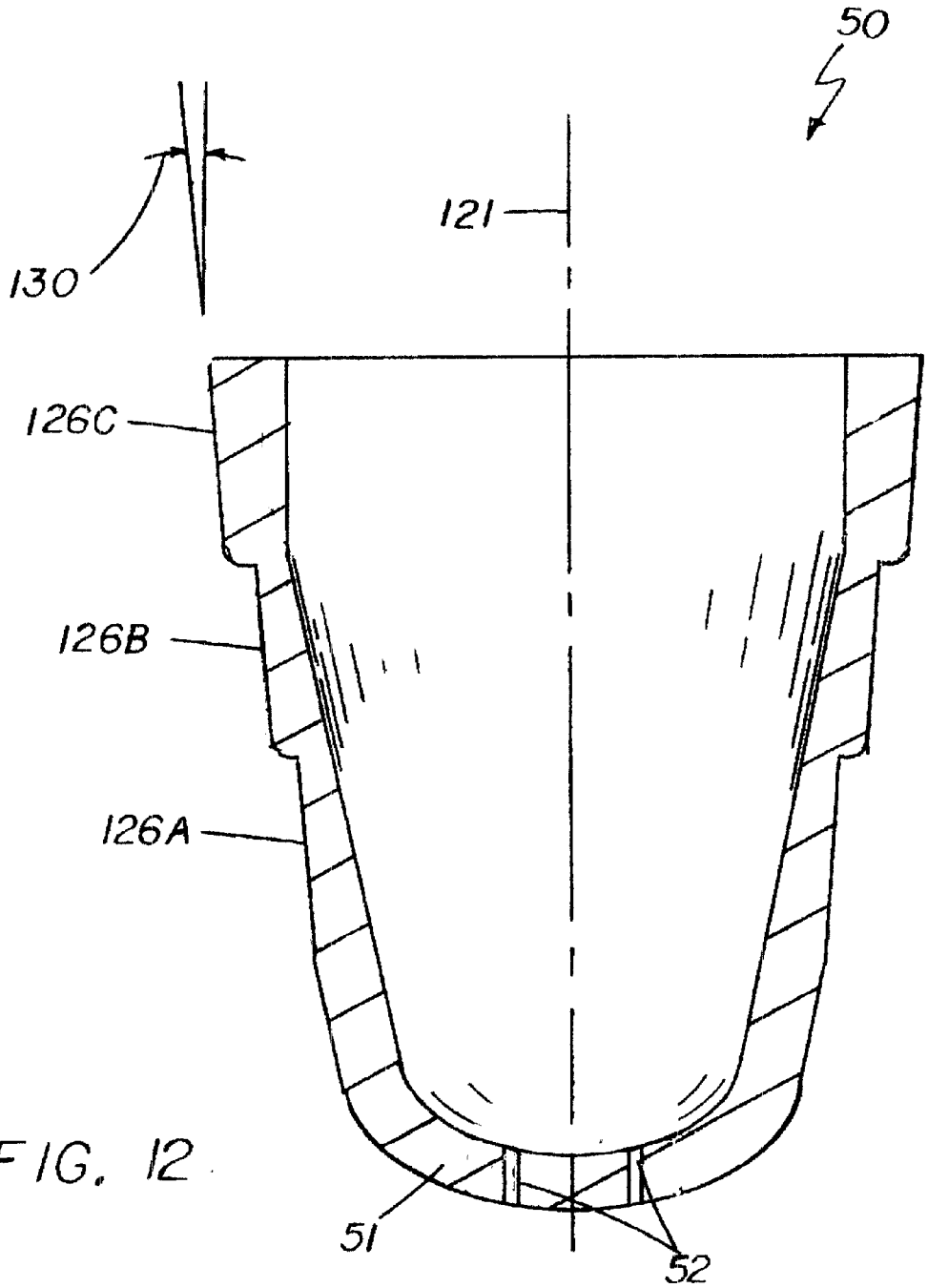
FIG. 12 is a cross-sectional side view of a further embodiment of an insert in accordance with drying apparatus of the invention.

Another form of a secondary insert 50 is shown in FIG. 12, having a plurality of steps 126A, 126B and 126C which are slanted at a low step angle 130 of less than about 6–8 degrees from the central axis 121 of secondary insert 50.

Figure 13A:
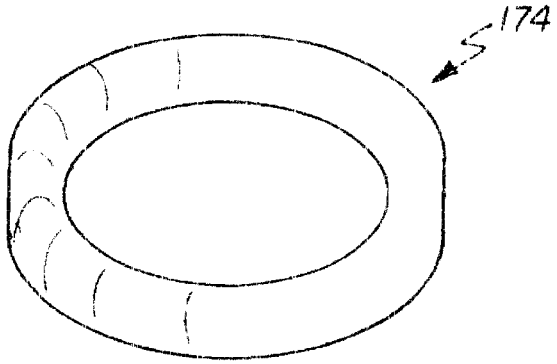
FIG. 13A is a perspective view of an elastic band useful for retaining a secondary insert in accordance with drying apparatus of the invention.
Figure 13B:
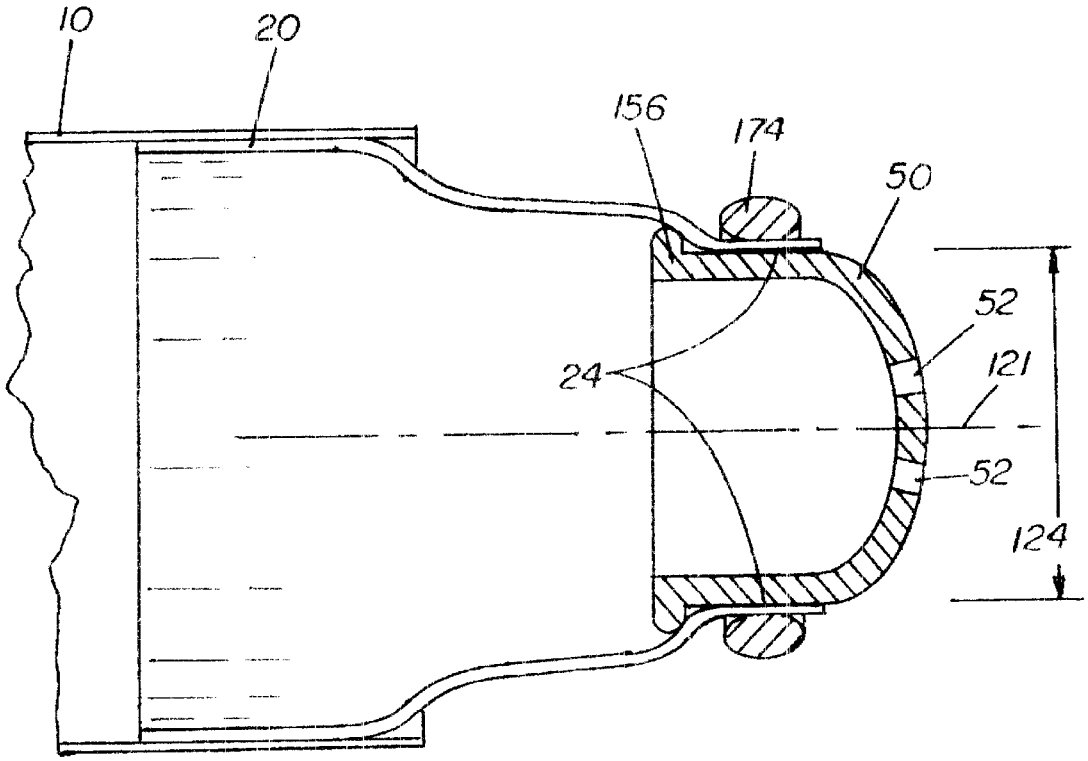
FIG. 13B is a cross-sectional side view of a limb end portion of a dry suit illustrating use of an elastic band for retaining a secondary insert in accordance with drying apparatus of the invention.

Another means for retaining a primary insert 42 or secondary insert 50 in the neck seal opening 34, wrist seal opening 24, or ankle seal opening 154 of a dry suit 10 is illustrated in FIGS. 13A and 13B. A seal such as a wrist seal 20, generally formed of an elastic material, is bonded to the dry suit 10 and has a wrist seal opening 24. In the example of FIG. 13B, a secondary insert 50 is placed in the wrist seal opening 24 and a generally circular elastic band 174 is placed over the insert and surrounding wrist seal 20 to hold the insert in place. In this example, the secondary insert 50 is shown as having a central axis 121, fits a wrist seal opening diameter of 124, and has insert exhaust orifices 52 and annular retaining lip 156. The elastic band 174 is shown as having an oval cross-sectional shape, but it may be of any shape which effectively retains the secondary insert 50 within the seal opening. The elastic band 174 may be used with a primary insert 42 or secondary insert 50 at any of the neck seal 30, wrist seal 20, and/or ankle seal 98.

The shape of the primary insert 42 and/or the secondary inserts 50 about central axes 121 need not be circular. The inserts may be ellipsoidal in shape, particularly in a form ranging from a circle to about a 35 degree ellipse, but without limitation thereto. In addition, the number of steps or the spacing therebetween is not limited to the values exemplified in the figures herein.

Where there is no need for inserts 42, 50 with multi-step exteriors, inserts having a single step diameter 116 may be used. An embodiment of a secondary insert 50 with only a single step diameter 116 is depicted in FIGS. 13 and 14. Thus, for example, a molded secondary insert 50 having a single step diameter 116 on a cylindrical body 162 has an outwardly extending lip 156 at a first end 158 and a second end 160 generally closed by endwall 164. The lip 156 retains the particular seal 20, 30, or 98 thereon. An exemplary longitudinal reinforcing structure 166 is shown with finger holes 168 for manipulating the insert 50 into and out of the seal. This feature may be incorporated into both primary inserts 42 and secondary inserts 50. Airflow insert exhaust orifices 52 pass through the endwall 164. Another feature which may be incorporated into a primary insert 42 or secondary insert 50 is a handle 170, which also aids in inserting and removing the insert from a seal.

Figure 15:
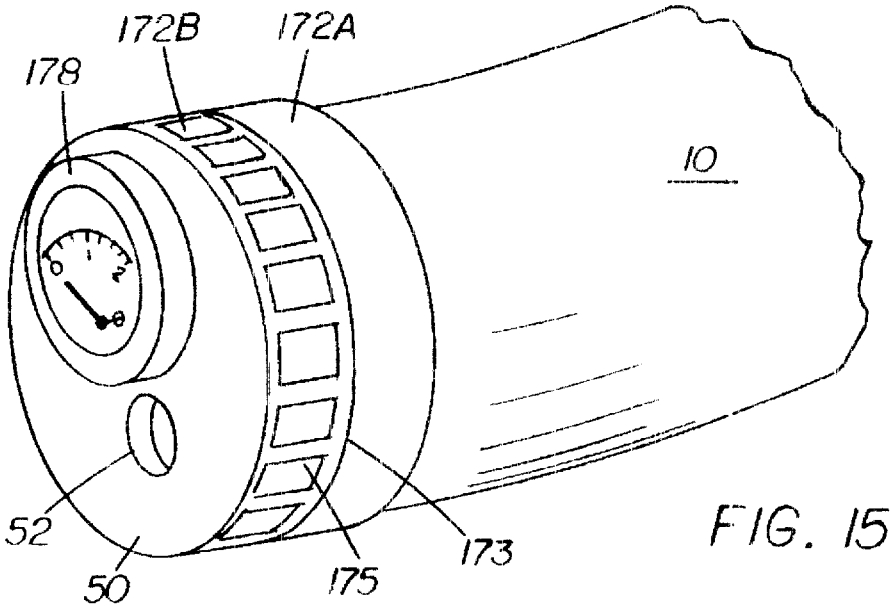
FIG. 15 is a partial view of an arm of a dry suit, showing a further embodiment of an insert in accordance with drying apparatus of the invention.
Figure 15A:
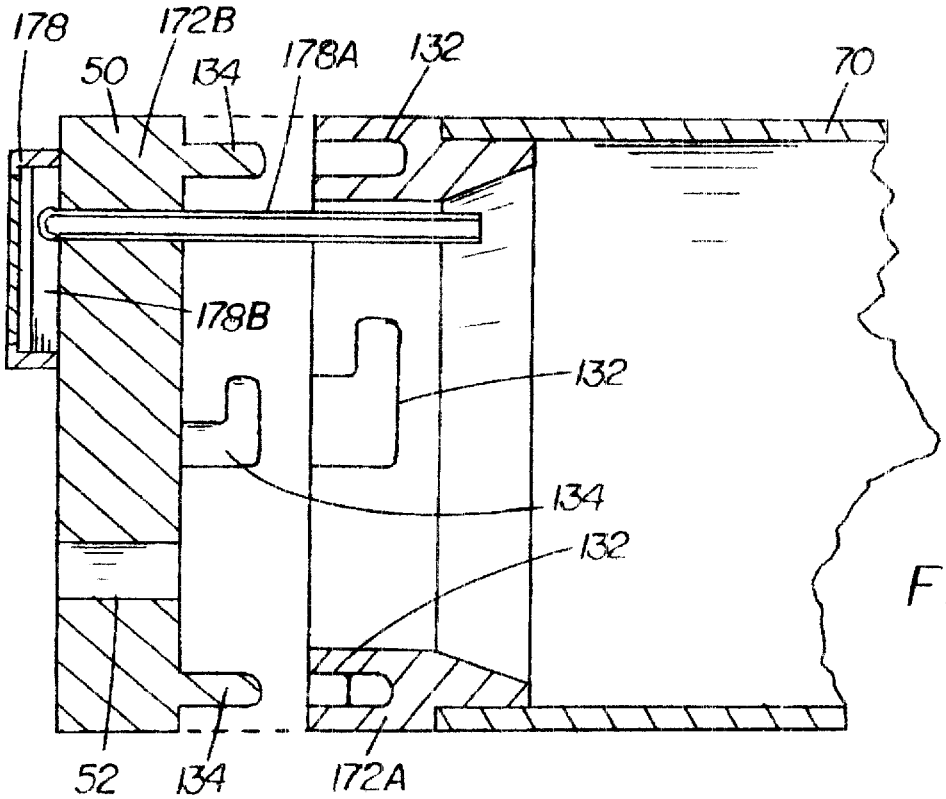
FIG. 15A is a cross-sectional side view through a further embodiment of an insert in accordance with drying apparatus of the invention.

Some dry suits 10 used for diving have "hard" seals which comprise, for example, split locking rings which can be closed and opened by a snapping or rotational movement. An example of a further embodiment of the invention adapted to these type of seals is illustrated in FIGS. 15 and 15A. Thus, for example, a dry suit 10 will have a first locking ring 172A at the suit opening, i.e. wrist, neck or ankle. For example, a commercially available dry suit may have a dry hand enclosure, not shown, with a matching locking ring and which is sealably attachable to the first locking ring 172A. First and second locking rings together comprise the wrist seal 20. In the apparatus of the present invention, a primary or secondary insert 42, 50 with one or more insert exhaust orifices 52 may be formed with a locking ring 172B, such that it may be sealingly connected to locking ring 172A, for drying the suit interior surfaces 26. As shown in FIG. 15A, the "secondary insert" 50, i.e. second locking ring 172B, may have hooks 134 which fit into latches 132 in the first locking ring 172A, and lock by rotation. This type of insert 42, 50 may be readily formed and is compact in size. A primary insert 42 having apparatus for blowing air into the suit 10 may also use locking rings or the like to match the neck, wrist or ankle seal configuration of the suit.

A further feature which may be incorporated into any insert 42 or 50 is shown in FIGS. 15 and 15A. A pressure indicator 178 is shown mounted on secondary insert 50, with a pressure tube 178A passing into the suit 10, for determining the actual pressure within the suit. The indicator 178 may use a small pressure mechanism 178B and be visible to a person using the drying apparatus. The pressure indicator may measure pressure over a relatively low range, for example from zero to 2 psig.

A further purpose of the primary insert 42 and secondary inserts 50 is to maintain the neck seal opening 98, wrist seal openings 20 and/or ankle seal openings 30 in a slightly stretched or expanded condition which will ensure that during use, the seals will not overcompress the neck, wrists or ankles and endanger the user. Thus, the dry suit 10 may be stored with the inserts 42, 50 installed within the openings 98, 20 and/or 30. Alternatively, the inserts 42, 50 may be installed one or more days prior to diving, to pre-stretch the elastic seals.

Figure 16:
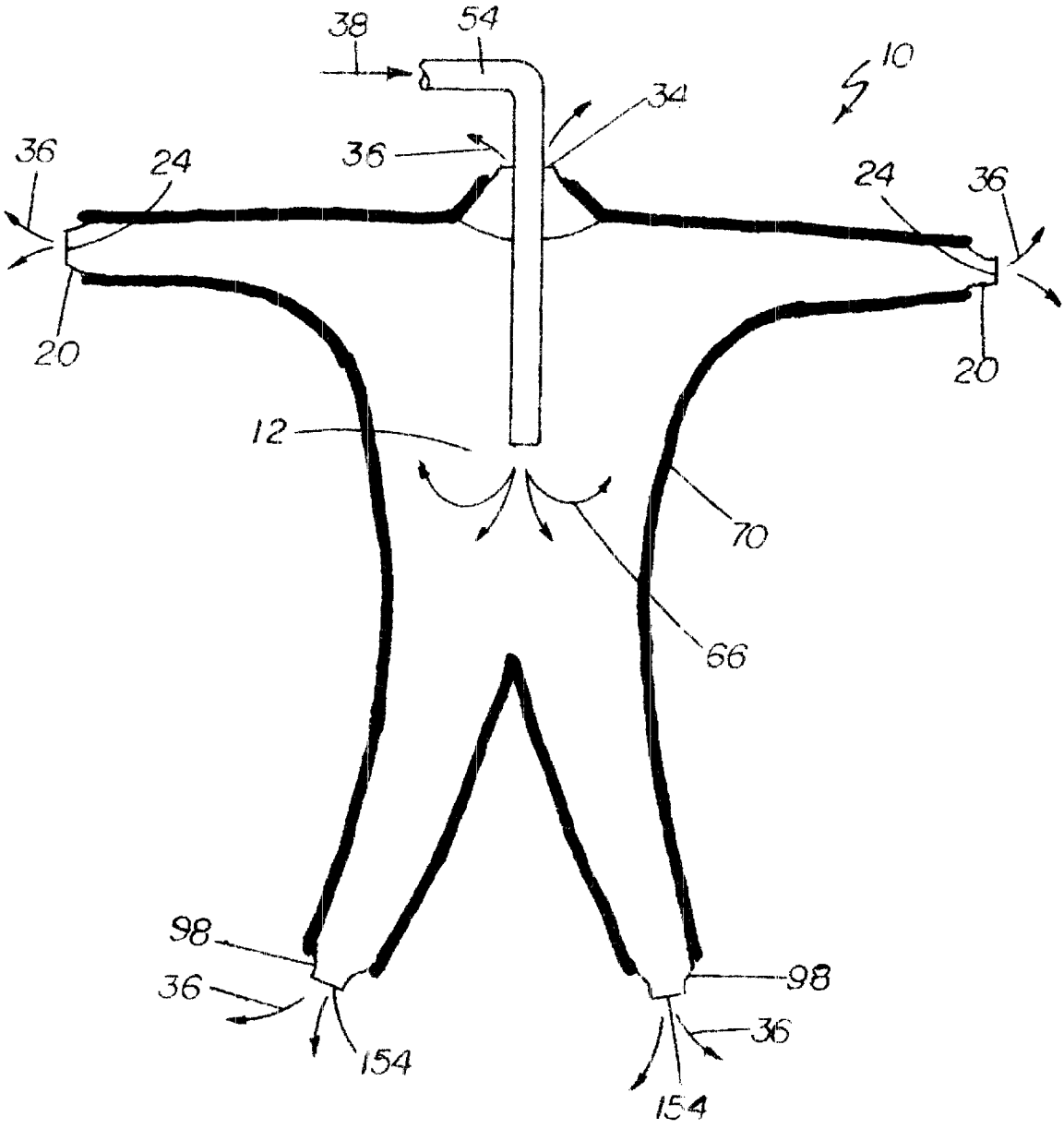
FIG. 16 is a cross-sectional side view of a dry suit with another embodiment of a dry suit dryer configuration in accordance with the invention.

In an alternative drying method shown in FIG. 16, no secondary inserts 50 are used. Instead, a relatively large flow stream 38 of low pressure compressed air is supplied by a blower through one of the suit openings. The airflow rate is sufficient to slightly inflate the dry suit 10 without inserts 42, 50. Typically, the stream 38 of pressurized drying air is discharged from the air distribution system 54 into a central portion, e.g. torso portion 12 of the suit, as drying air stream 66. The air stream 66 is continuously exhausted from the suit 10 as exhaust air 36 through the neck seal opening 34 of neck seal 30, wrist seal openings 24 of seal 20, and ankle seal openings 154 of ankle seals 98 in the suit 10. This embodiment is particularly useful where both the wrists and ankles have seals with openings.

Where the suit 10 being dried is a diving wet suit or other suit at least partially formed of an air-permeable material, it may be necessary to use secondary inserts 50 having no discharge exhaust orifices 52 to maintain a minimal inflation pressure. Alternatively, simple clamps may be used to close the wrist openings 24 and the ankle openings 154.

Figure 16A:
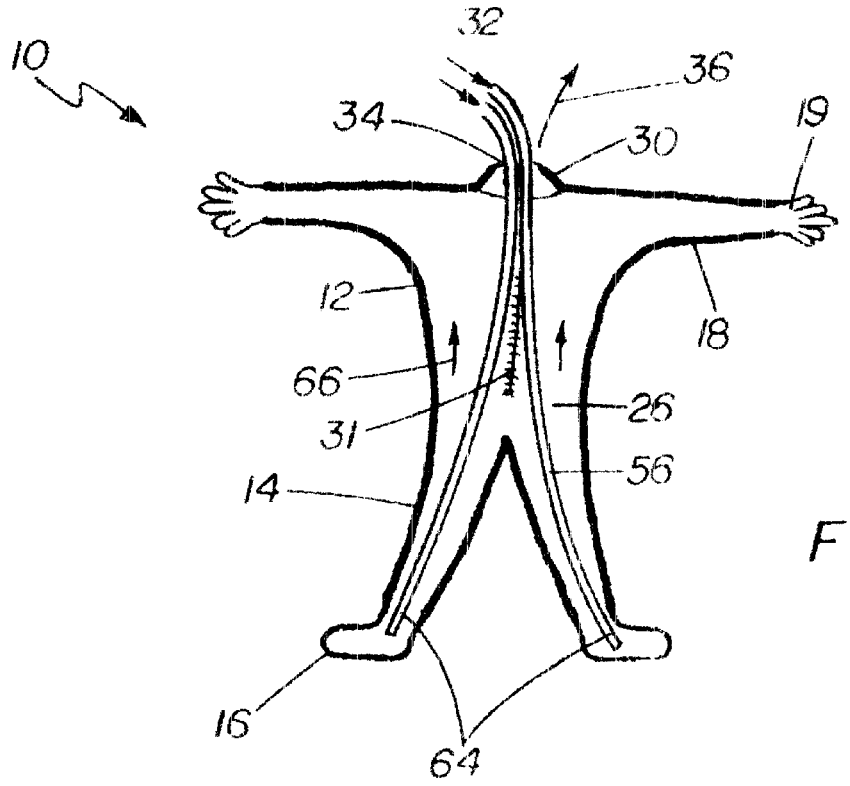
FIG. 16A is a cross-sectional front view of a dry suit showing a step in drying the dry suit with a further embodiment of air-carrying conduits of the invention.
Figure 16B:
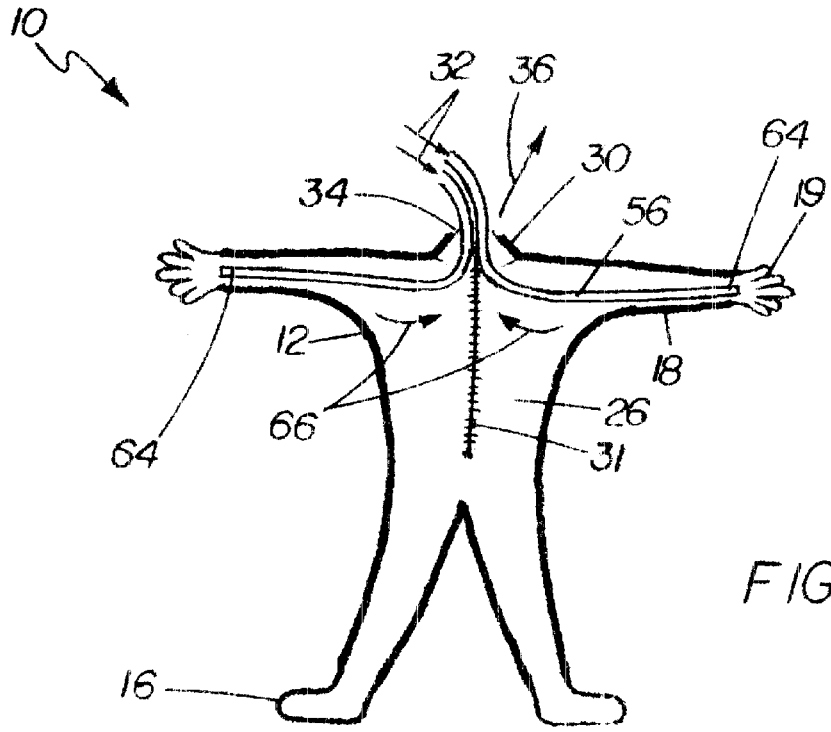
FIG. 16B is a cross-sectional front view of a dry suit showing a further step in drying the dry suit with a further embodiment of air-carrying conduits of the invention.

Turning now to FIGS. 16A and 16B, which show an exposure suit 10 having only one opening, i.e. neck seal opening 34, when the suit zipper 31 is closed. The suit 10 is shown with integral gloves or hand portions 19 and integral foot portions 16. As shown in the figures, primary conduits 56 may first be extended into the foot portions 16, and drying air passed through the conduit distal ends 64 until the interior surfaces 26 of the foot portions 16, leg portions 14 and torso portion 12 are dry. The primary conduits 56 are then retracted from the foot portions 16 and placed in the arm portions 18 for drying the hand portions 19 and arm portions.

FIGS. 21 through 28 depict several variations in which may be incorporated in an exposure suit dryer/treater apparatus 40. In the exploded view of FIG. 21, a blower assembly 44 (which normally includes a heater) may be assembled with a flow controller 300 to controllably supply drying air to two auto-extending conduits 56. The conduits 56 are formed of thin plastic tubes which may be flattened and rolled up as shown. The rolled-up ends 57 will unfurl upon application of airflow into the conduits 56. This type of conduit 56 occupies little space, enable easy mounting of the suit 10 on the primary insert 42, and have reduced tendency to stick to or catch on the suit's interior surface 26. The composition of the plastic conduits 56 may be controlled to provide a non-stick plastic. For example, the conduits 56 may comprise polyethylene tubing of 2–4 mil thickness which is joined to form flat tubing of the desired diameter (when inflated).

The flow controller 300 may take many forms, one embodiment of which is illustrated in FIGS. 21–24. The flow controller 300 includes a flow control piece 254 rigidly attachable to blower 44, shown here as having an electrical switch 108 on handle 87, and connectable to a power supply, not shown, by electrical power cord 92. The control piece 254 includes side wall 258 and a control plate 260 with a control orifice 266. The control piece 254 has a lower surface 262 with a central screw 43 about which the control piece may rotate in direction 264 relative to the upper surface 268 of an attached primary insert 42. The control piece 254 is shown in ghost lines relative to the primary insert 42 in FIG. 24.

The primary insert 42 is shown as a truncated cone with upper surface 268, lower edge 269 and side surface 270. The insert 42 is insertable and retainable in the neck seal opening 34 of a neck seal 30. The upper surface 268 is shown with three openings, including an inflation channel 272 and two tube channels 274, 276. The tube channels 274, 276 terminate in ferrules 278 and 280, respectively, to which the inlet ends 65 of conduits 56 may be attached. For example, a conduit's inlet end 65 may be slipped over a ferrule and clamped in place. The inflation channel 272 leads into the interior of suit 10 for rapid inflation. The channels 272, 274, 276 are arranged in the upper surface 268 so that rotation of the control plate 260 will controllably provide airflow to any of (a) the inflation channel 272 only, (b) to one of the tube channels 274, 276 (together with a portion of the inflation channel 272, or (c) to both tube channels, merely by rotation of the control plate 260 about axis 120 of screw 43. As shown, the blower outlet 48 is mounted within flow control piece 252 and retained rigidly therein by an attachment hook 256, for example, which attaches to the blower 44.

The flow control piece 254 and primary insert 42 are preferably formed of plastic, but may alternatively be made of hard rubber, aluminum or other essentially rigid material.

FIGS. 21–24 illustrate only one of many possible configurations of a flow controller 300. Any configuration may be used by which the flow of drying air may be optionally controlled between simply a rapid filling of the suit 10 and conduits 56 leading to the foot portions 16 and/or hand portions 19. Thus, the suit 10 may be first rapidly filled and inflated without passing significant quantities of air through the conduits 56. Then, air may be directed to the conduits 56, whether rigid, flexible or extendable, for introduction into the foot or hand portions. The introduced air dries the foot portions 16, leg portions 14 and torso portion 12 as it passes upwardly through the suit 10.

Figure 27:
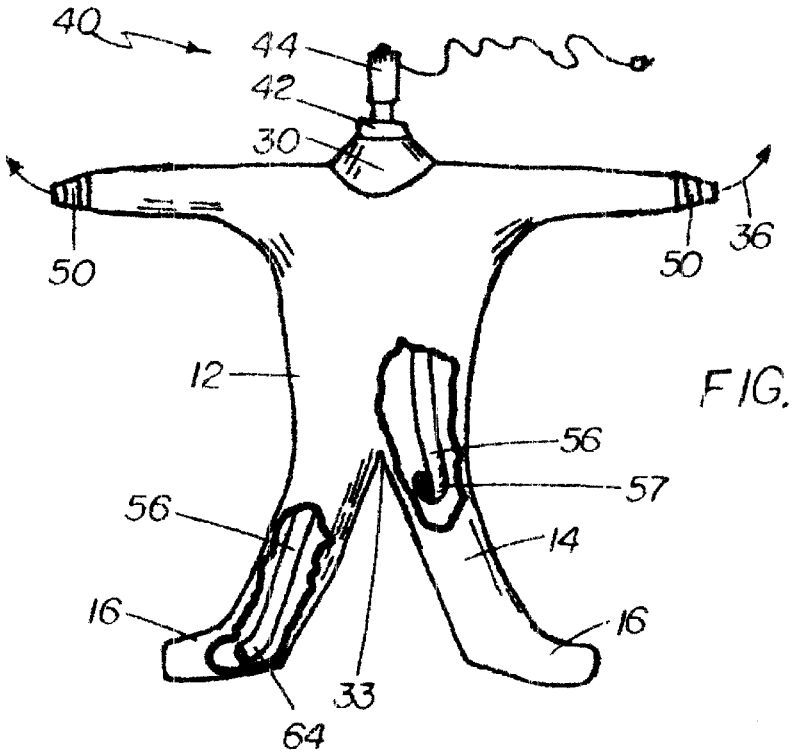
Figure 28:
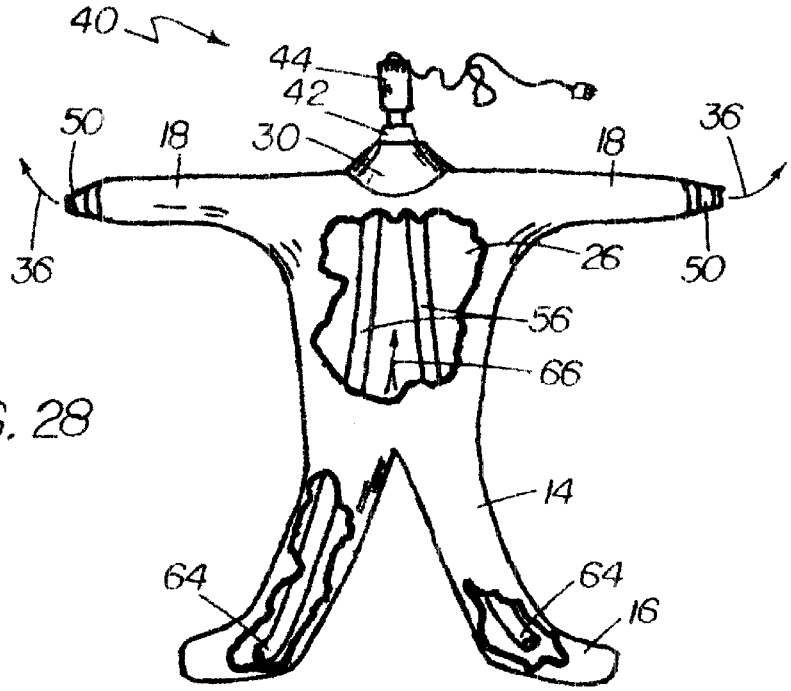

FIGS. 25, 26, 27 and 28 illustrate steps in initiating drying of a dry suit 10 using "inflatable" self-extending conduits 56 depicted in FIG. 21. In this example, the dry suit 10 is shown with closed foot portions 16 and open arm portions 18. As shown in FIG. 25, the dryer/treater apparatus 40 is installed in a dry suit 10, with the conduits 56 preferably unrolled so that the rolled-up ends 57 are at a level approximately even with or below the crotch 33, one conduit in each leg portion 14. Secondary inserts 50 are placed in each arm or wrist opening. The zipper 31 is closed and the blower 44 activated to rapidly fill the suit 10 with air, inflating the suit. As shown in FIG. 27, the flow controller 300 is then activated to introduce air through one of the conduits 56, forcing its distal end 64 into a foot portion 16. As depicted in FIG. 28, the flow controller 300 is further activated to introduce air through the other conduit 56, and the drying air 66 passes upwardly from the foot portions 16 to dry the interior surfaces 26 of the suit and discharge through secondary inserts 50.

Figure 29:
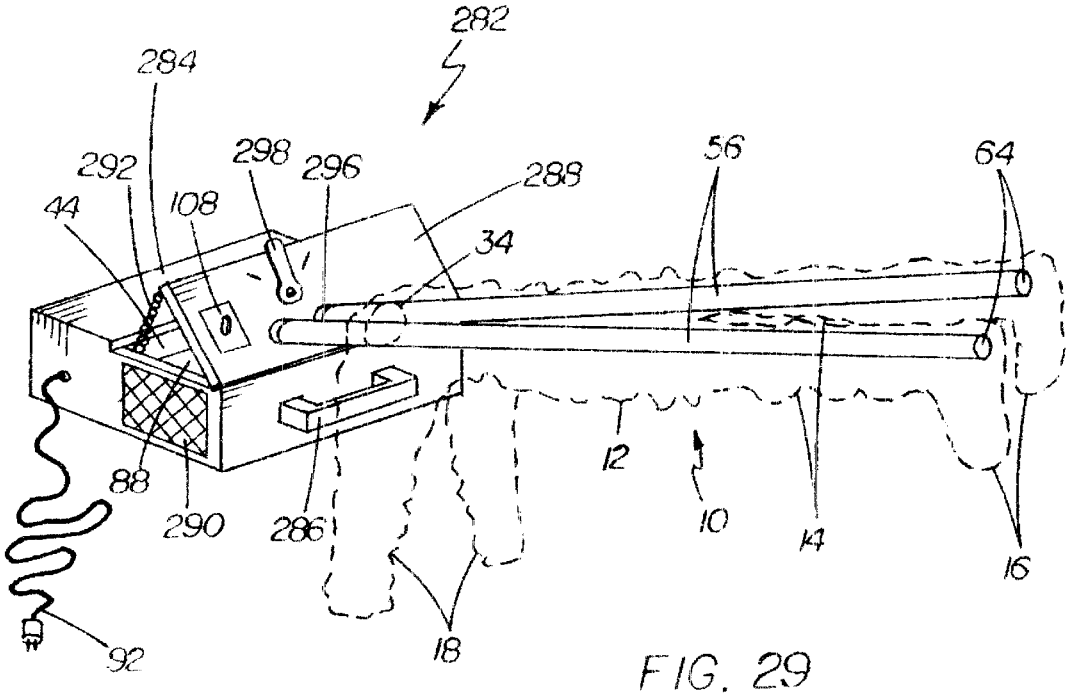
FIG. 29 is a perspective view of a portable drying apparatus of the invention.

FIG. 29 illustrates a portable suit drying kit 282 which may be carried in a boat or vehicle. The kit 282 includes a container 284 holding a blower assembly 44 and heating element 88. A swiveling mounting board 288 holds tube connectors 296 to which drying conduits 56 may be attached. The mounting board 288 is shown as swivelable to an angle convenient for sliding a suit 10 onto the conduits 56, one conduit in each leg portion 14. The kit 282 is illustrated with a power cord 92, power switch 108, air inlet 290, a chain/cord to limit the movement of the mounting board 288, and a handle 286. In addition, a control lever 298 is shown which controls airflow to either or both conduits 56. A primary insert 42, not shown, is insertable into the suit's neck seal opening 34. The kit will provide a primary insert 42 and secondary inserts 50 of any useful configuration; the primary insert may include a quick-inflation channel 272 as already described.

Figure 30:
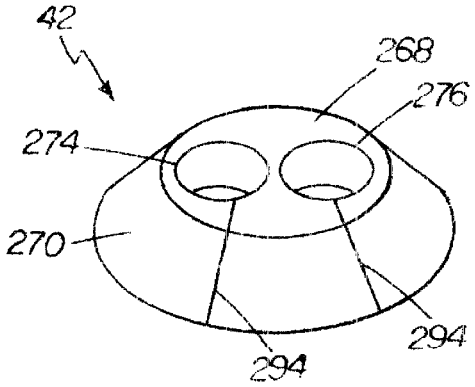
FIG. 30 is a perspecive view of another embodiment of a primary insert of a drying apparatus of the invention.

FIG. 30 shows a simple primary insert 42 which may be attached to the conduits 56 in a neck seal 30 following placement of the conduits in a suit 10. The insert 42 has slits 294 which extend from the first and second tube channels 274, 276 to the exterior. Thus, when formed of a material such as rubber, the insert 42 may be distorted to open the slits 294, permitting passage of the conduits 56 therethrough.

Figure 31:
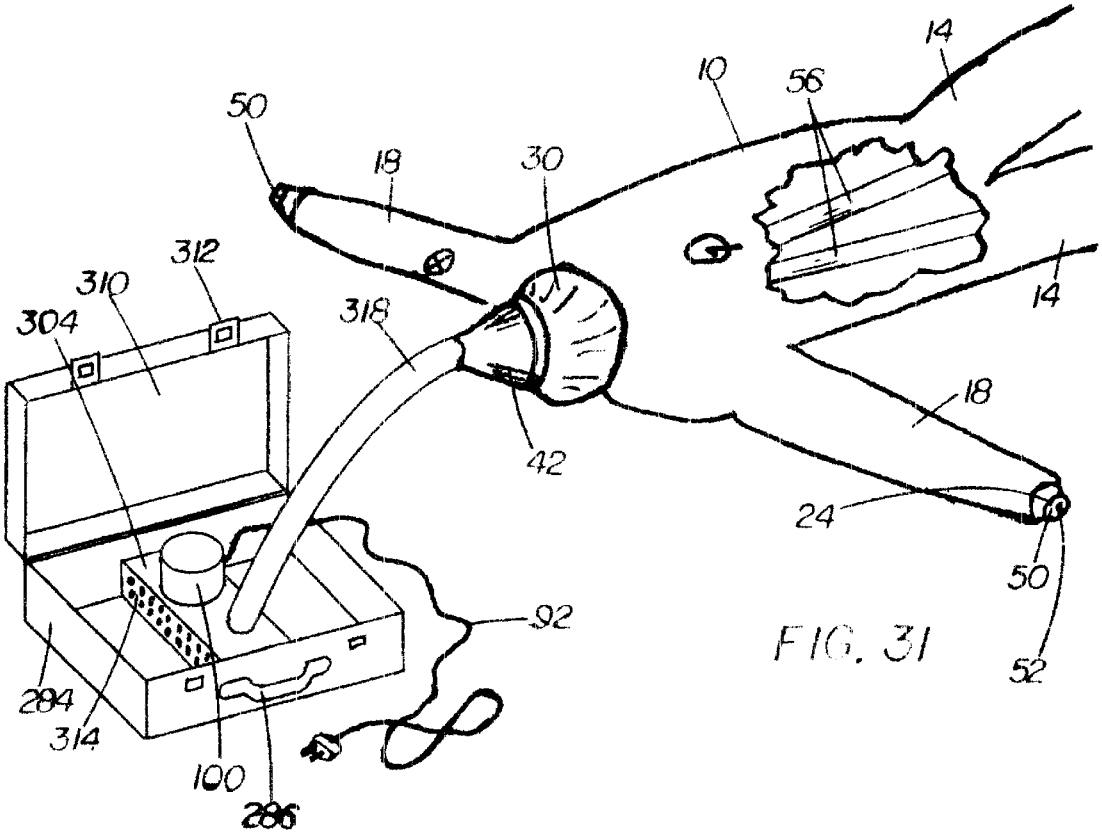
FIG. 31 is a perspective view of another embodiment of a portable drying apparatus of the invention, shown as installed on an exposure suit.
Figure 32:
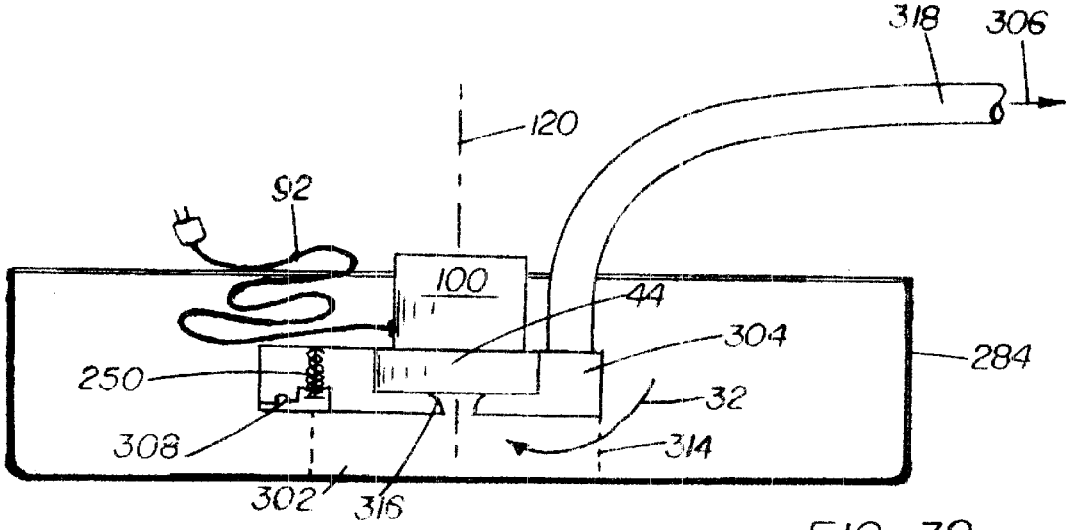
FIG. 32 is a front cross-sectional view of a dryer case showing portions of a portable drying apparatus shown in FIG. 31.

Another embodiment of a portable suit drying kit 282 is depicted in FIGS. 31 and 32. In carrying case 284 is a low pressure air plenum 302 with openings 314 to the atmosphere for incoming air 32. A blower inlet 316 permits air to flow from the low pressure plenum 302 to a centrifugal blower assembly 306, which compresses air to a higher pressure and discharges it into high pressure plenum 304. The blower assembly 306 is driven by motor 100. A transfer hose 318 is attached to the high pressure plenum 304 to direct the pressurized air 306 to a primary insert 42. The primary insert 42 is shown installed in the neck seal 30 of exposure suit 10, for inflating and drying the suit. Secondary inserts 50 are depicted in the wrist seal openings 24 of the suit, for limiting the discharge rate of humidified air.

The maximum outlet pressure of a blower assembly 306 will typically be greater than the desired inflation pressure. Thus, for example, a blower assembly 306 capable of delivering a maximum pressure of 30 inches water column may typically be used to provide a positive pressure of less than 10 inches water column within an exposure suit 10. If for example, the insert exhaust orifices 52 became plugged, the suit pressure may rise to a level where it will become damaged. In this dryer embodiment, excess pressure is relieved from the high pressure plenum 304 by an overpressure relief valve 250. In a further safety feature shown in FIG. 32, passage of air through the relief valve 250 activates a noise generator 308 such as a whistle or chattering device. The noise will alert an attending person that the insert exhaust orifices 52 need to be cleared.

In the event that the drying air 306 requires heating to increase the drying rate, heating elements may be provided within the low pressure plenum 302 or high pressure plenum 304.

It should be appreciated that case 284 may be sized to carry all parts of the drying apparatus, including the transfer hose 318, conduits 56, and inserts 42, 50. The case 284 is shown with a cover 310 and latches 312 for maintaining the case in a closed condition.

Figure 17:
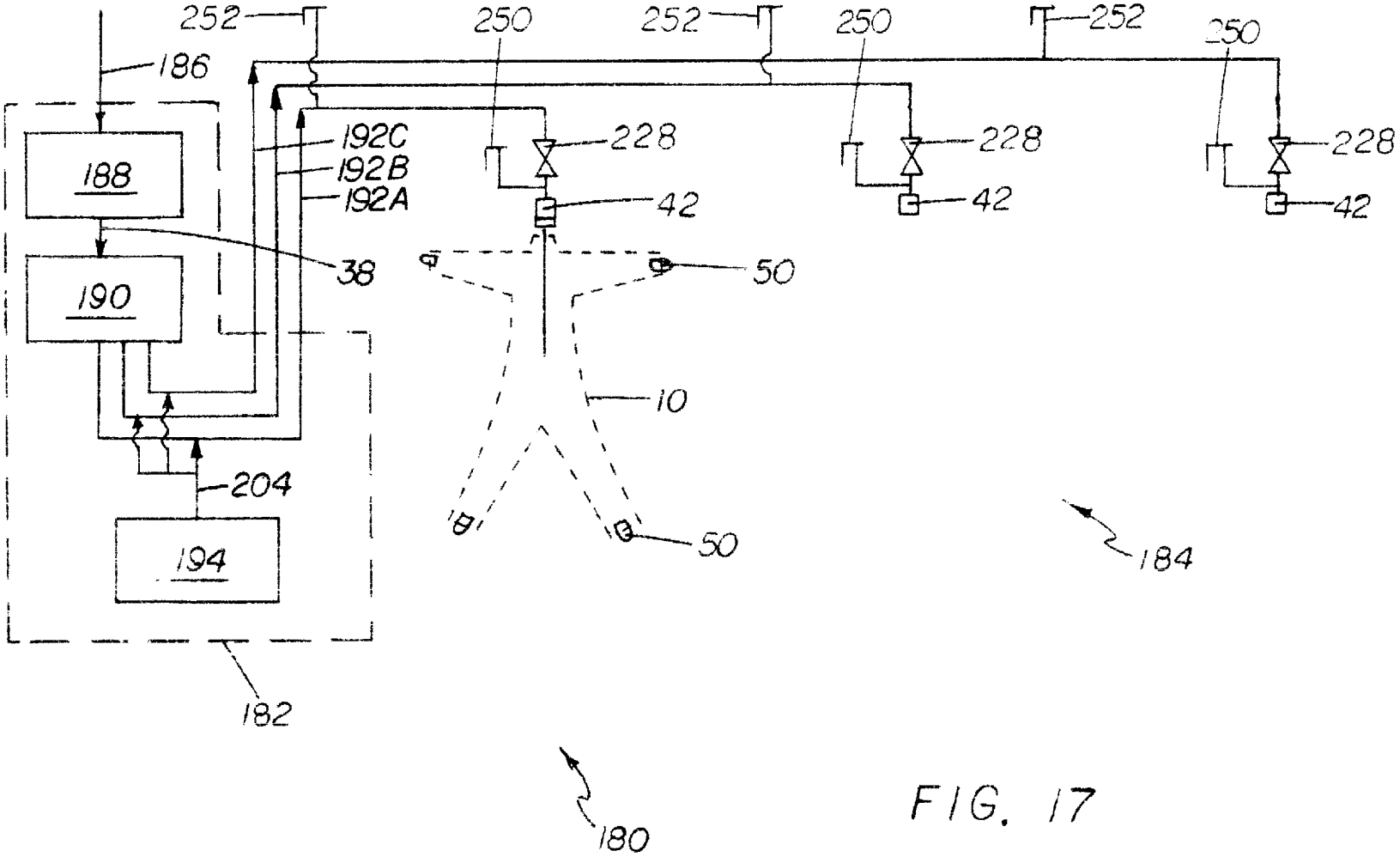
FIG. 17 is a schematic view of a multi-unit dry suit dryer in accordance with the invention.
Figure 18:
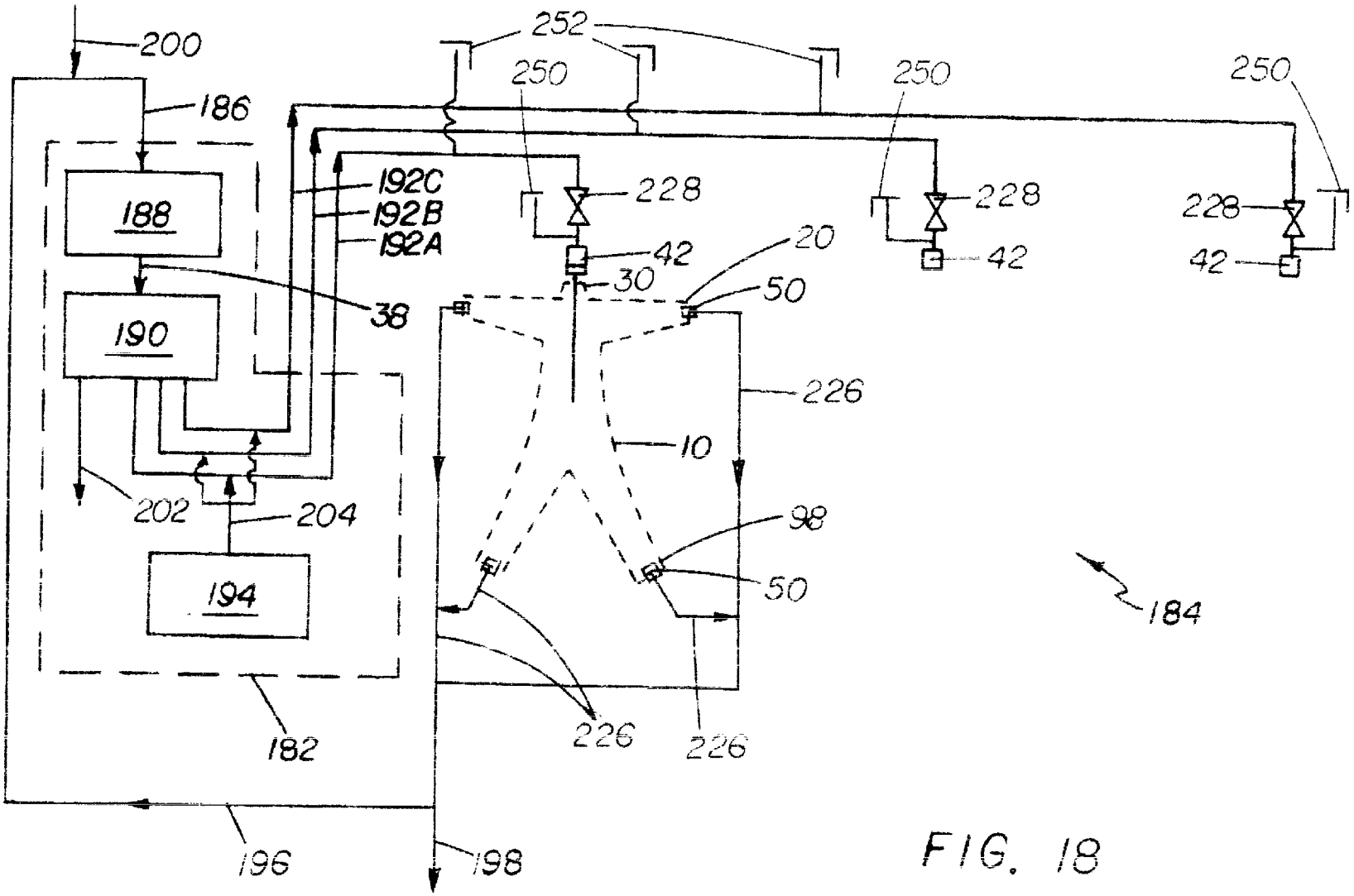
FIG. 18 is a schematic view of another embodiment of a multi-unit dry suit dryer of the invention.
Figure 19:
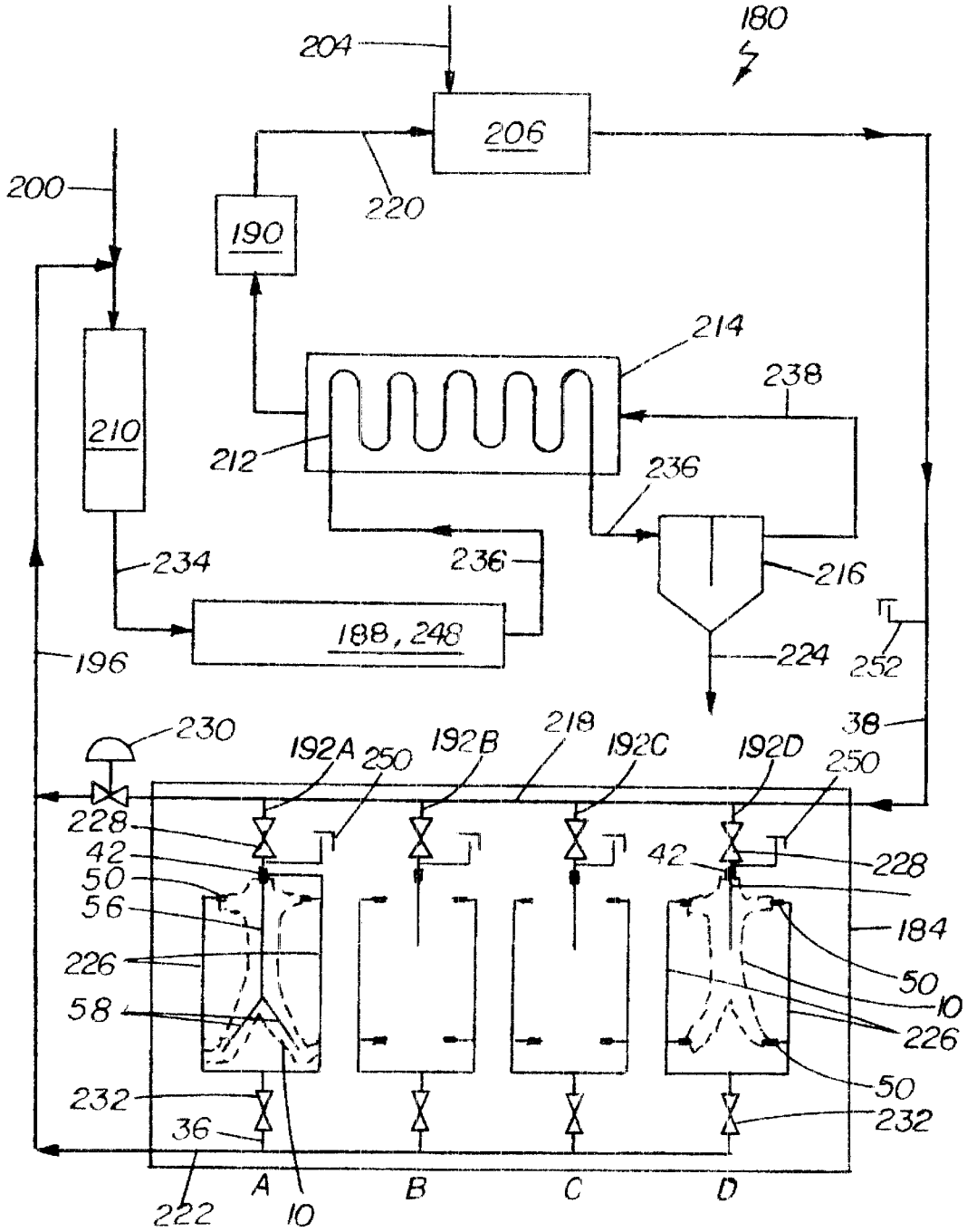
FIG. 19 is a schematic view of a further embodiment of a multi-unit dry suit dryer of the invention.

Apparatus for the simultaneous drying of a plurality of dry suits 10 is illustrated in FIGS. 17, 18 and 19. As shown in FIG. 17, a multi-suit drying apparatus 180 comprises an air processing unit 182 and an air distribution unit 184. As shown, the air processing unit 182 includes an air intake 186, a blower 188, and an air heater 190, and has sufficient air flow and heating capacity to dry a plurality of suits 10 simultaneously. As shown, an air distribution system 54 comprises a bank of air conduits 192A, 192B, and 192C for drying/treating a plurality of dry suits 10. Each air conduit terminates in a primary insert 42 for introducing the air into a dry suit 10, and may include valves 228, tube connections, primary and/or secondary conduits 56, 58, inserts 42 and/or 50, etc., as already described herein. Wet air is discharged through secondary inserts 50 as already described.

The air heater 190 may comprise apparatus for heating the compressed air stream 38 by electrical or other means. A heat pump, well known in similar arts, may be used to first cool the air stream 38 to condense water therefrom, and then reheat the air stream.

An optional feature of the air processing unit 182 is a chemical agent injection unit 194 for injecting a chemical agent 204 by pressure or by a venturi effect into the compressed air stream 38. Where the chemical agent 204 is gas such as nitrogen, it may be injected as the total stream in the conduit 192A, 192B, or 192C.

The multi-drying apparatus 180 may be automated to any degree, including a control panel, not shown, for controlling the operation of the various components. An automatic stop feature may be provided which halts the drying process based on the differential in humidity between the incoming drying air stream and the exhaust air. As illustrated in FIG. 17, the multi-drying apparatus 180 provides a once-through system wherein the drying air comprises fresh air which is compressed and heated.

As depicted in FIG. 18, the wet exhaust air 36 from each insert 42, 50 in the wrist seals 20 and ankle seals 98 and/or neck seal 30 is collected in air pickup conduits 226 and combined into a recycle stream 196 which is directed to the blower 188 for recompression. A portion of the wet air recycle stream 196 may be vented as wet air stream 198 to the atmosphere, and replaced by an air makeup stream 200. In this configuration, a heat pump is incorporated into the air heater 190, and moisture 202 is condensed and removed from the stream 38 of pressurized drying air.

FIG. 19 illustrates further features which may be incorporated in a multiple-suit drying apparatus 180. As shown, a distribution unit 184 comprises an air supply manifold 218 which controllably feeds a stream of pressurized drying air to each of a plurality of dry suits 10 through individual valved air conduits 192A, 192B, 192C, 192D, etc., each of which passes through a primary insert 42. A valve 228 in each air conduit 192A, 192B, 192C, and 192D controls the flow of drying air into a dry suit 10. A valve 228 is shut when the station A, B, C or D is idle. A control valve 230 or other device maintains the air pressure in the air supply manifold 218.

In each drying station A,B, C or D, exhaust air pickup conduits 226 are provided with secondary inserts 50 to capture the wet exhaust air 36 passing from the suit 10 through insert exhaust orifices 52, as previously described. A wet air manifold 222 collects the wet exhaust air 36 from pickup conduits 226 and recycles it for re-use. The air pickup conduits 226 are provided with valves 232 which may be shut when the station is idle.

Any number of stations may be provided in the multi-suit apparatus 180, depending upon the air flow capacity of the blower 188 at the desired pressure. FIG. 19 depicts the drying apparatus with station A configured for drying suits 10 with continuous foot portions 16. Thus, the air conduit 192A includes a primary conduit 56 and secondary conduits 58.

Also shown is Station D configured for drying suits 10 with both wrist seals 20 and ankle seals 98. Thus, the secondary inserts 50 are connected to the air pickup conduits 226 for capturing and recycling the wet exhaust air 36 as wet recycle stream 196. Makeup air 200 may be added to wet recycle stream 196 or alternatively at other points in the air stream. The recycle stream 196 may then be passed through a particulate filter 210 to remove particulates. Filter 210 may be for example a physical (e.g. bed) filter or an electrostatic filter. The filtered air stream 234 is then compressed by compressor 248 or blower 188 to a positive pressure, and the pressurized air stream 38 is passed through post compression air cooling pipe 212 in a heat exchanger 214, whereby the air stream 38 is cooled and water is condensed from the stream. For this type of system, the output pressure of the compressor 188 is at least 10 psi (pounds per square inch) but preferably is between about 10 psi and about 100–150 psi. Higher pressures would generally require compressors of greater sophistication, but may be practical for large drying installations.

The cooled air stream 236 is passed into an expansion chamber/separator 216 in which the pressure is lowered to a value consonant with achieving the desired pressure within dry suits 10. Condensed water 224 together with a small quantity of entrained air is discharged. The dehumidified air stream 238 is passed through the heat exchanger 214 and heated by contact with the post compression air cooling pipe 212 and/or the head of the compressor. The heated dehumidified air stream 220 may be further heated by an auxiliary heater 190 if needed to increase evaporation in the dry suits 10.

If it is desired to provide a chemical agent 204 to the heated dehumidified air stream 220, the chemical agent 204 may be added to a mixing chamber 206 to combine with the heated dehumidified air stream 220, for example, and the mixture is passed as a stream 38 of pressurized drying air to the air supply manifold 218 for controlled distribution to each suit 10 to be dried.

As shown in FIGS. 17, 18 and 19, an overpressure release valve 250 for low pressure and an overpressure release valve 252 for suit supply are provided upstream and downstream of each valve 228, to ensure that the air conduits 192 and exposure suits 10, respectively, are not overpressurized. These valves 250, 252 have a relatively low pressure setting, and valves 252 will be set to relieve pressurized air at a pressure only slightly higher than the desired pressure within the dry suits 10.

The multi-suit drying apparatus 180 of FIG. 19 is very energy-efficient for simultaneous drying of a plurality of dry suits 10. Heat required for evaporation in the dry suits 10 is partially recovered by condensation in the post compression air cooling pipe 212.

Figure 20:
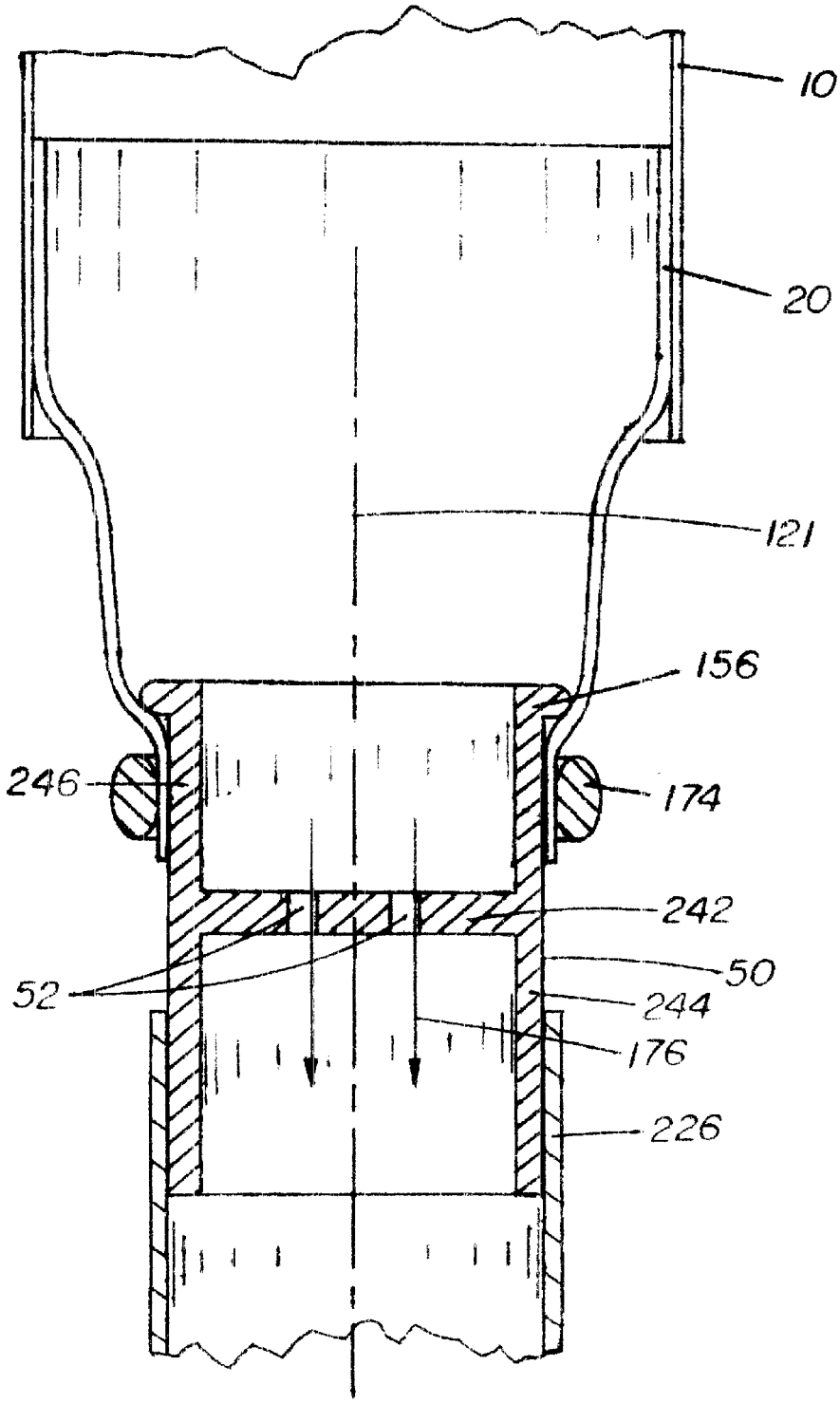
FIG. 20 is a cross-sectional side view of another embodiment of a primary insert.

Any of the foregoing versions of secondary inserts 50 may be adapted to provide recycling of the wet air 176 discharged through exhaust orifices 52. An example is depicted in FIG. 20, in which the insert 50 comprises a tubular shaped device with a first portion 246 comprising an upstream end insertable in a seal opening 24, 34, or 154, a second portion 244 comprising a downstream end which is joined to an air pickup conduit 226, and a cross-wall or bulkhead 242 generally perpendicular to the central axis 121 of the insert.

It is evident that various features of the differing embodiments described above may be combined. For example, a drying/treating apparatus 40 may comprise a blower/heater assembly 44, and a conduit such as a flexible hose connected to the assembly 44 and a primary insert 42, or otherwise having one end inserted into a dry suit 10. Thus, the blower/heater assembly 44 is separated from the primary insert 42 by a conduit of any convenient length.

The numerous advantages of this invention have been noted in the above description. Other advantages may become evident as the drying apparatus is made and used commercialy or in defense applications. While the drying apparatus may be used to dry any body suit which may need internal drying, it is particularly useful in drying a so-called "dry suit" for diving which has either closed or open feet. Where the wearer's feet are exposed by open ankle seals 98, the ankle seal openings 154 may be fitted with inserts 42 or 50, with or without orifices 52. Alternatively, the ankle seal openings 154 may be merely clamped shut or closed with an insert, and dry air introduced at the lower terminus of each leg.

Various embodiments of the dryer described herein may find usefulness in drying other types of apparatus. For example, the dryer may be used to dry various containers, particularly those which are elongate or have difficult access.

It is apparent to those skilled in the art that numerous changes, additions and modifications may be made in the improved method and apparatus for drying/treating the interior of an exposure suit as disclosed herein without departing from the spirit and scope of the invention. Thus, the protection desired is defined by the appended claims including equivalents thereof:

What is claimed is:

1. An apparatus for removing moisture from a water resistant or waterproof exposure suit which has a neck opening and at least one of wrist openings and feet openings between an interior and an exterior of the suit, the apparatus comprising:

a blower for blowing drying air in a stream at an elevated pressure;

conduit means connected to said blower and configured to pass through one of said openings into said interior, to discharge said drying air stream into the interior of said suit;

flow-limiting means insertable into at least one of said wrist openings and foot openings;

whereby said air stream is directed into the interior to absorb said moisture, be humidified thereby and to be discharged from openings including at least one of the wrist openings, and a neck opening.

2. An apparatus in accordance with claim 1, further comprising heating means to heat said air stream.

3. An apparatus in accordance with claim 2, wherein said heater has a heating capacity enabling heating said air stream to a temperature of between about 90 degrees F. and about 140 degrees F.

4. An apparatus in accordance with claim 2, further comprising means for activating and deactivating said heater.

5. An apparatus in accordance with claim 1, wherein said exposure suit comprises one of a diving dry suit, a diving wet suit, a fire fighting suit, a temperature insulating suit, a hazardous material cleanup suit, a clean suit and a sterility suit.

6. An apparatus in accordance with claim 1, wherein said conduit means is configured to pass through said neck opening.

7. An apparatus in accordance with claim 6, wherein said neck opening has a neck seal, and further comprising a primary insert attachable to said conduit means and to said neck seal to maintain elevated pressure in said interior.

8. An apparatus in accordance with claim 1, wherein said flow-limiting means comprises an insert plugging one of said wrist opening and said foot opening, said insert having an orifice therethrough having a size configured to discharge a controlled flowrate of humidified air from the suit interior to the atmosphere.

9. An apparatus in accordance with claim 8, further comprising means for adjusting the flowrate between a lower value and an upper value.

10. An apparatus in accordance with claim 9, wherein said lower value of flowrate is substantially zero.

11. An apparatus in accordance with claim 1, wherein said flow-limiting means is generally conical for plugging a variety of sizes of one of said wrist openings and foot openings.

12. An apparatus in accordance with claim 1, wherein said flow-limiting means is stepped, each step comprising a surface for plugging a size of one of said wrist openings and foot openings.

13. An apparatus in accordance with claim 1, further comprising a semi-rigid ring for clamping one of a wrist seal and a foot seal to said flow-limiting means.

14. An apparatus in accordance with claim 1, wherein said suit has mechanical attachment means for attaching at least one of hand portions and foot portions to the suit, and wherein said flow-limiting means has mechanical locking means for attachment to said mechanical attachment means.

15. An apparatus in accordance with claim 1, further comprising pressure measuring means attached to said flow-limiting means and having a visible indicator to indicate pressure in the suit interior.

16. An apparatus in accordance with claim 1, wherein said flow-limiting means limit airflow therethrough to maintain said interior at an elevated pressure which inflates and smooths the exposure suit to a pressure below a damage-causing pressure.

17. An apparatus in accordance with claim 1, wherein said flow-limiting means limit airflow therethrough to maintain said interior at an elevated pressure of about 0.02 psig to about 1 psig (about 0.5 inches to about 27 inches water).

18. An apparatus in accordance with claim 1, wherein said flow-limiting means limit airflow therethrough to maintain said interior at an elevated pressure which inflates and smooths the exposure suit to a pressure below a damage-causing pressure.

19. An apparatus in accordance with claim 1, further comprising means for activating and deactivating said blower.

20. An apparatus in accordance with claim 1, wherein said conduit means comprises two conduits, each conduit configured to be inserted into a leg portion of said suit for introducing drying air to said foot portions.

21. An apparatus in accordance with claim 1, wherein said conduits comprise one of rigid and semi-rigid members.

22. An apparatus in accordance with claim 1, wherein said conduits comprise shape-retaining bendable tubes.

23. An apparatus in accordance with claim 1, wherein said conduits comprise plastic membranes flattenable and rollable into cylinders.

24. A portable drying apparatus for drying an exposure suit having an interior and an exterior comprising a torso portion, arm portions, leg portions, foot portions, neck opening an wrist openings, said apparatus comprising:

an electric blower for compressing a drying stream of air;

a primary insert for plugging said neck opening of an exposure suit;

two conduits attachable to said primary insert and extendable into leg portions of said suit;

at least one conduit opening passing through said primary insert for attachment of conduits thereto;

an inflation opening passing through said primary insert for enhanced airflow to said interior;

means for directing airflow from said blower to said primary insert; and means for controlling airflow from said blower to alternately flow through one of said inflation opening and said conduit opening.

25. A portable drying apparatus in accordance with claim 24, further comprising a heater for heating said drying air.

26. A portable drying apparatus in accordance with claim 24, further comprising wrist inserts for plugging said wrist openings, and secondary wrist inserts having orifices therethrough for discharge of air from said interior.

27. A portable drying apparatus in accordance with claim 24, wherein said conduits comprise one of rigid and semi-rigid members.

28. A portable drying apparatus in accordance with claim 24, wherein said conduits comprise shape-retaining bendable tubes.

29. A portable drying apparatus in accordance with claim 24, wherein said conduits comprise plastic membranes flattenable and rollable into cylinders.

30. A portable drying apparatus in accordance with claim 24, wherein said means for controlling airflow comprises a valve including a pair of mating rotatable members, one member having an inflation orifice and at least one conduit orifice and the other member having an orifice configured to be movable between said inflation orifice and said at least one conduit orifice.

31. A portable drying apparatus in accordance with claim 24, further comprising a carrying case for containing all elements of said drying apparatus.

32. A portable drying apparatus in accordance with claim 31, wherein said carrying case includes means for attaching said conduits thereto and holding said conduits at an upward angle for mounting of said suit thereon.

33. A portable drying apparatus for drying an exposure suit, comprising:

a carrying case;

air pressurization means in said case, comprising;

a first plenum communicating with the atmosphere for providing input air;

a centrifugal blower mounted on said first plenum and configured to draw air therefrom a motor for driving said blower;

a second plenum for accepting compressed air from said blower;

tube means for passage of compressed air from said second plenum to an exposure suit; and means for relieving excess pressure of compressed air from said apparatus to prevent overpressurization of said exposure suit.

34. A portable drying apparatus in accordance with claim 33, wherein said means for relieving excess pressure comprises a relief valve to discharge excess air and prevent overpressurization of said exposure suit.

35. A portable drying apparatus in accordance with claim 33, further comprising noise-making means indicative of said discharge of excess air.

36. A portable drying apparatus in accordance with claim 35, wherein said noise-making means comprises one of a whistle and chatter caused by movement of said excess air.

37. A portable drying apparatus in accordance with claim 33, further comprising a heater mounted in one of said plenums to heat said drying air.

38. An apparatus for drying an exposure suit having an exterior and an interior and a neck opening and at least one of wrist openings and foot openings between said interior and said exterior, said apparatus comprising:

a blower for compressing air to an elevated pressure;

an electrical heater in communication with said blower for heating the compressed air;

conduit means having:

a first end in communication with said blower; and a second end insertable through said neck opening;

a primary insert sealingly attached to said conduit means and configured to be sealingly inserted within said neck opening;

at least one secondary insert having a flow-restricting opening therethrough, said secondary insert sealingly insertable within at least one of said wrist openings and said foot openings to control discharge of humid air from said interior and form elevated pressure therein; and electrical means for operating said blower and heater for discharging warm air from said second end of conduit means into said interior.

39. An apparatus in accordance with claim 38, wherein a said secondary flow-restricting insert is attachedly inserted in each of said at least one of wrist openings and foot openings to limit the total flow of humid air from said interior and maintain said pressure therein.

40. An apparatus in accordance with claim 38, wherein said conduit means comprises:

a pair of conduits, each of said pair configured to terminate in one of said foot portion and hand portion for discharging warm air therein.

41. An apparatus in accordance with claim 38, further comprising:

means for recovering said discharged humid air;

means for removing humidity therefrom; and means for introducing said dehumidified recovered air to said blower.

42. An apparatus in accordance with claim 41, wherein said means for removing moisture comprises means for cooling, condensing and discharging moisture therefrom.

43. An apparatus in accordance with claim 35, further comprising means for injecting a chemical agent into said air stream.

44. An apparatus in accordance with claim 43, wherein said chemical agent is a gas comprising at least one of an antifungal agent, antibacterial agent, inert gas and ozone.

* * * * *